US010315419B2

(12) United States Patent
Cleary

(10) Patent No.: US 10,315,419 B2
(45) Date of Patent: Jun. 11, 2019

(54) METHOD FOR ASSIGNING COMMUNICATION ADDRESSES

(71) Applicant: Eastman Kodak Company, Rochester, NY (US)

(72) Inventor: Joseph P. Cleary, Kettering, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 34 days.

(21) Appl. No.: 15/712,201

(22) Filed: Sep. 22, 2017

(65) Prior Publication Data

US 2019/0092005 A1 Mar. 28, 2019

(51) Int. Cl.

| | |
|---|---|
| ***B41J 15/00*** | (2006.01) |
| ***B41J 2/08*** | (2006.01) |
| ***B41J 2/09*** | (2006.01) |
| ***B41J 2/095*** | (2006.01) |
| ***B41F 33/16*** | (2006.01) |
| ***B41J 2/085*** | (2006.01) |
| *B41J 2/03* | (2006.01) |
| *B41J 2/105* | (2006.01) |
| *B41J 2/02* | (2006.01) |

(52) U.S. Cl.

CPC ..... *B41J 2/085* (2013.01); *B41J 2/09* (2013.01); *B41J 2/095* (2013.01); *B41J 2/105* (2013.01); *B41J 2002/022* (2013.01); *B41J 2002/033* (2013.01)

(58) Field of Classification Search

CPC ..... G05B 2219/21028; G05B 2219/21039; G06F 13/37; G06K 15/105; G06K 2215/111; B41J 2/085; B41J 2/095; B41J 2/09; B41J 2002/022; B41J 2002/033; B41J 2/105; B41J 19/00; B41J 3/543

See application file for complete search history.

(56) References Cited

U.S. PATENT DOCUMENTS

| | | | |
|---|---|---|---|
| 5,204,669 | A | 4/1993 | Dorfe et al. |
| 5,535,336 | A | 7/1996 | Smith et al. |
| 6,050,191 | A | 4/2000 | Enderle et al. |
| 6,349,235 | B1 | 2/2002 | Gibart et al. |

(Continued)

*Primary Examiner* — Ahmed Elallam
(74) *Attorney, Agent, or Firm* — Kevin E. Spaulding

(57) ABSTRACT

A production system such as an inkjet printer system includes a plurality of communication distribution devices connected in a daisy chain arrangement. A plurality of secondary devices, such as printhead electronics boards for inkjet printheads, is connected to each of the communication distribution devices. A first communication distribution device which is connected to a system controller assigns a communication address to itself from a first set of communication address and assigns communication addresses to its connected secondary devices from a second set of communication addresses. It then communicates information to the next communication distribution device specifying the next available communication addresses. This process continues down the chain of communication distribution devices. The assigned communication addresses are then transmitted to the system controller. The assigned communication addresses enable the system controller to determine the relative physical locations of the communication distribution devices and secondary devices.

19 Claims, 15 Drawing Sheets

(56) References Cited

U.S. PATENT DOCUMENTS 6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,563,596 B1 * 5/2003 Narushima ..... H04N 1/00002 358/1.14
6,575,566 B1 6/2003 Jeanmaire et al.
6,588,888 B2 7/2003 Jeanmaire et al.
6,738,920 B1 5/2004 Horne
6,772,232 B1 8/2004 Newell, Jr. et al.
6,779,873 B2 * 8/2004 Maeda ..... B41J 2/2132 347/41
6,793,328 B2 9/2004 Jeanmaire
6,827,429 B2 12/2004 Jeanmaire et al.
6,851,796 B2 2/2005 Jeanmaire et al.
6,902,254 B2 * 6/2005 Sugaya ..... B41J 3/543 347/12
7,121,639 B2 * 10/2006 Plunkett ..... B41J 2/04505 347/13
7,399,043 B2 * 7/2008 Walmsley ..... B41J 2/04505 347/13
7,565,470 B2 7/2009 Lin
7,774,511 B2 8/2010 Zatelman et al.
7,871,145 B1 1/2011 Enge
8,205,017 B2 6/2012 Parr et al.
8,226,215 B2 7/2012 Bechler et al.
8,585,189 B1 11/2013 Marcus et al.
8,651,632 B2 2/2014 Marcus
8,651,633 B2 2/2014 Marcus et al.
8,654,580 B2 2/2014 Koudar
8,696,094 B2 4/2014 Marcus et al.
8,888,256 B2 11/2014 Marcus et al.
9,227,439 B1 * 1/2016 Katerberg ..... B41J 11/0095
9,379,974 B2 6/2016 Ohta et al.
9,527,319 B1 12/2016 Brazas et al.
9,566,798 B1 2/2017 Tunmore et al.
9,623,689 B1 4/2017 Piatt et al.
10,052,868 B1 * 8/2018 Tunmore ..... B41J 2/04505
2004/0062257 A1 4/2004 Nguyen
2018/0194133 A1 * 7/2018 Yamato ..... B41J 2/04548

* cited by examiner

METHOD FOR ASSIGNING COMMUNICATION ADDRESSES

FIELD OF THE INVENTION

This invention pertains to the field of inkjet printing and more particularly to a method for allocating communication addresses in a modular printhead assembly including a plurality of removable jetting modules.

BACKGROUND OF THE INVENTION

In the field of high speed inkjet printing, it is desirable to be able to print across the width of the print media in a single pass of the print media past a print station. However, for many applications the desired print width exceeds the width of the available printheads. It is therefore necessary to arrange an array of printheads such that each printhead in the array prints a print swath, and the set of print swaths cover the desired print width. Such arrays of printheads are commonly configured in lineheads that include alignment hardware to maintain the desired relative alignment of the printheads, as well as fluid and electronic hardware to support the printheads within the linehead. As new applications are being developed for the use of high speed inkjet printing technology, such as the printing of labels, books, magazines, packaging materials, and décor (such as wallpaper, and laminate material for flooring and countertops), there is a need to develop an increasing number of lineheads to accommodate the increasing number of desired print widths.

To simplify the development of the various lineheads, it is desirable to employ a modular design approach for printhead alignment hardware and the supporting fluid and electronic hardware. In an exemplary configuration, each of the modules includes three printheads together with their supporting fluid and electrical hardware. By combining different numbers of modules together, lineheads of different sizes can be created.

Even though the printheads are assembled into modules within the lineheads, it is still desirable to be able to separately control and communicate each of the individual printheads within the linehead. There is also a need to be able to remove and replace individual printheads within the lineheads without shutting down the other printheads in the linehead. To achieve these goals, there is a need to automatically and adaptively assign communication addresses to facilitate communication of control signals and data with the various system components.

SUMMARY OF THE INVENTION

The present invention represents a method for assigning communication addresses to devices within a production system, includes:

providing a system controller for controlling the production system, the system controller including a communication port;

providing a plurality of communication distribution devices, each of the communication distribution devices including:

first and second primary communication ports through which the communication distribution device can be connected to another communication distribution device or to the system controller;

a plurality of secondary communication ports, the plurality of secondary communication ports being arranged in a defined sequence; and means to detect whether the communication distribution device is connected by means of the first primary communication port or the second primary communication port to another one of the plurality of communication distribution devices or to the system controller;

connecting the plurality of communication distribution devices together using the first and second primary communication ports in a daisy chain arrangement to form a connected sequence of communication distribution devices, wherein a first communication distribution device in the sequence of communication distribution devices is connected to the system controller via one of its first and second primary communication ports such that each communication distribution device is enabled to communicate with the system controller;

providing a plurality of secondary devices;

connecting each of the secondary devices to one of the secondary communication ports of one of the communications distribution boards;

specifying a first set of communication addresses from which communication addresses can be assigned to each of the communication distribution devices, the communication addresses of the first set of communication addresses having a prescribed sequence;

specifying a second set of communication addresses distinct from the first set of communication addresses, from which communication addresses can be assigned to each of the secondary devices, the communication addresses of the second set of communication addresses having a prescribed sequence;

wherein the system controller provides a signal to a first communication distribution device in the connected sequence of communication distribution devices via one of its first and the second primary communication ports;

upon detecting the signal from the system controller by the first communication distribution device, the first communication distribution board:

assigns itself a first communication address in the prescribed sequence of the first set of communication addresses;

sequentially assigns communication addresses from the prescribed sequence of the second set of communication addresses to the secondary devices connected to its secondary communication ports; and communicates information to the next communication distribution device in the connected sequence of communication distribution devices via one of its first and second primary communication ports, the information specifying that the next communication distribution device should assign itself a next communication address in the prescribed sequence of the first set of communication addresses and specifying the next available communication address in the prescribed sequence of the second set of communication addresses that is available to be assigned to the secondary devices connected to the next communication distribution device;

upon receiving the communicated information from the previous communication distribution device in the connected sequence of communication distribution devices each subsequent communication distribution device in the connected sequence of communication distribution devices:

assigns itself the received communication address in the prescribed sequence of the first set of communication addresses;

sequentially assigns communication addresses from the prescribed sequence of the second set of communication addresses to the secondary devices connected to its secondary communication ports starting with the received next available communication address; and unless it is the last communication distribution device in the connected sequence of communication distribution devices, communicates information to the next communication distribution device in the connected sequence of communication distribution devices via one of its first and second primary communication ports, the information specifying that the next communication distribution device should assign itself a next communication address in the prescribed sequence of the first set of communication addresses and specifying the next available communication address in the prescribed sequence of the second set of communication addresses that is available to be assigned to the secondary devices connected to the next communication distribution device; and transmitting information from each communication distribution device in the connected sequence of communication distribution devices communicate to the system controller, the information specifying the communication addresses assigned to each communication distribution device and the communication addresses assigned to each of the secondary devices connected to each communication distribution device.

This invention has the advantage that it enables a plurality of secondary devices to be connected through communication distribution devices to a system controller and automatically assigned communication addresses in a manner that provides the system controller with unambiguous location information for the individual secondary devices.

It has the additional advantage that it provides a means for detecting when individual secondary devices or communication distribution devices are either connected to or disconnected from the communication network. Furthermore, the method enables communication addresses to be assigned or unassigned to the newly connected or disconnected devices, while not interfering with communication to other devices that are connected to the communication network.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
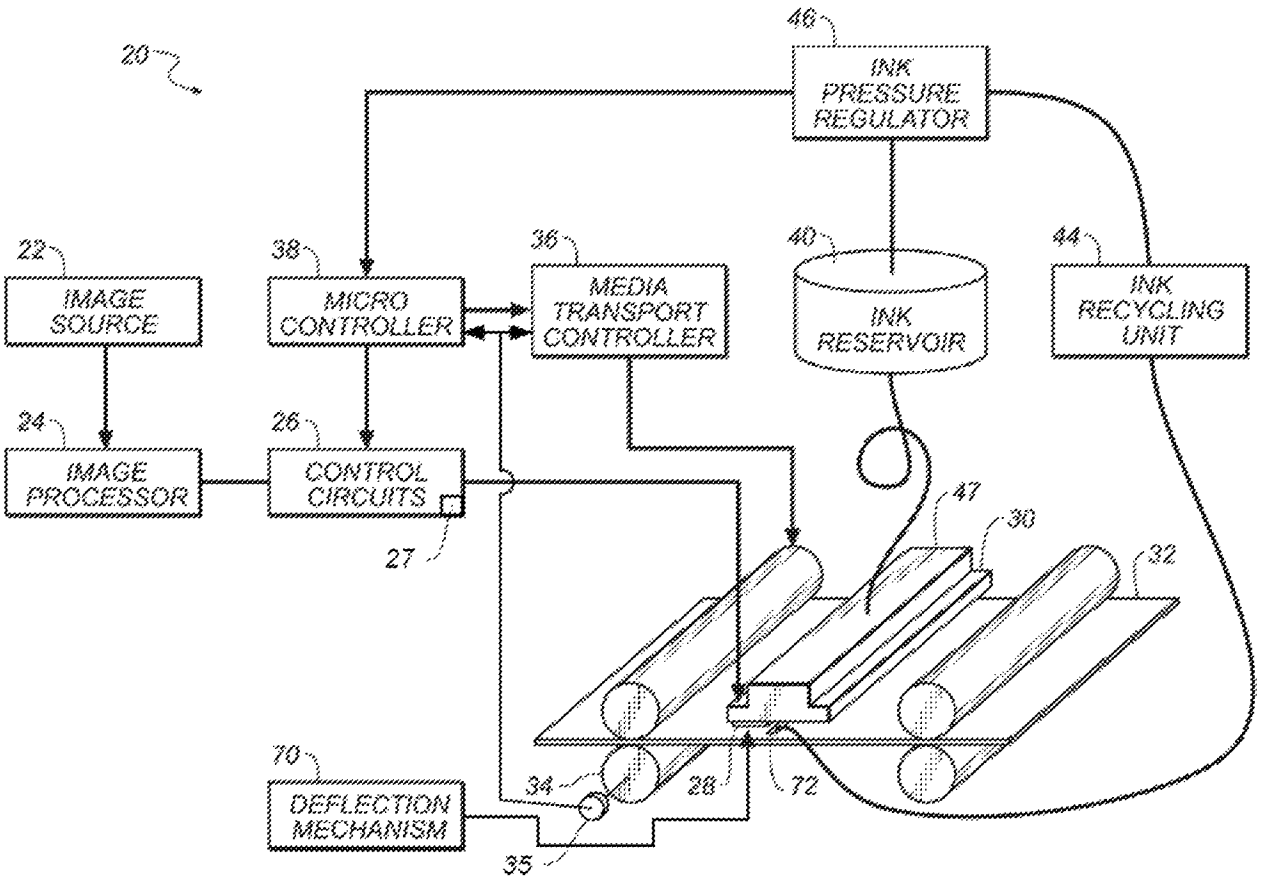
FIG. 1 (Prior Art)
FIG. 1 is a simplified block schematic diagram of an exemplary continuous inkjet system.

The present description will be directed in particular to elements forming part of, or cooperating more directly with, apparatus in accordance with the present invention. It is to be understood that elements not specifically shown or described may take various forms well known to those skilled in the art. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The example embodiments of the present invention are illustrated schematically and not to scale for the sake of clarity. One of the ordinary skills in the art will be able to readily determine the specific size and interconnections of the elements of the example embodiments of the present invention.

The present invention is directed at providing an effective means for a controller to communicate with individual devices that are part of a production system. In particular, the invention is directed toward assigning communications addresses in a production system in which some of the devices are communication hubs or communication distribution devices through which the controller can communicate with a plurality of secondary devices. The invention supports configurations in which a particular secondary device in the production system may be deactivated or removed from the production system while other secondary devices in the production system are still active and in communications with the system controller.

The invention will be described in terms of an embodiment in which the production system is an inkjet printing system including a plurality of inkjet printheads in communications with a system controller. The invention, however, is not limited to inkjet printing, but can also be used for other types of production devices. Another exemplary embodiment of a production system includes a plurality of robotic devices, in which at least some of the robotic devices are equipped with a plurality of specialty end of arm devices that each can communicate with the system controller via the robotic device. The system controller must be able to communicate both with the robotic device and also with the plurality of end of arm devices.

As described herein, exemplary embodiments of the present invention provide a printhead or printhead components typically used in inkjet printing systems. However, many other applications are emerging which use printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit (image processor) 24 which also stores the image data in memory. A plurality of drop-forming transducer control circuits 26 reads data from the image memory and apply time-varying electrical pulses to a drop-forming transducers 28 that are associated with one or more nozzles of a printhead 30. These pulses are applied at an appropriate time, and to the appropriate nozzles, so that drops formed from a continuous inkjet stream will form spots on a print medium 32 in the appropriate position designated by the data in the image memory.

Print medium 32 is moved relative to the printhead 30 by a print medium transport system 34, which is electronically controlled by a media transport controller 36 in response to signals from a speed measurement device 35. The media transport controller 36 is in turn is controlled by a microcontroller 38. The print medium transport system 34 shown in FIG. 1 is a schematic only, and many different mechanical configurations are possible. For example, a transfer roller could be used in the print medium transport system 34 to facilitate transfer of the ink drops to the print medium 32. Such transfer roller technology is well known in the art. In the case of page width printheads, it is most convenient to move the print medium 32 along a media path past a stationary printhead. However, in the case of scanning print systems, it is often most convenient to move the printhead along one axis (the sub-scanning direction) and the print medium 32 along an orthogonal axis (the main scanning direction) in a relative raster motion.

Ink is contained in an ink reservoir 40 under pressure. In the non-printing state, continuous inkjet drop streams are unable to reach print medium 32 due to an ink catcher 72 that blocks the stream of drops, and which may allow a portion of the ink to be recycled by an ink recycling unit 44. The ink recycling unit 44 reconditions the ink and feeds it back to the ink reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to the ink reservoir 40 under the control of an ink pressure regulator 46. Alternatively, the ink reservoir 40 can be left unpressurized, or even under a reduced pressure (vacuum), and a pump can be employed to deliver ink from the ink reservoir 40 under pressure to the printhead 30. In such an embodiment, the ink pressure regulator 46 can include an ink pump control system. The ink is distributed to the printhead 30 through an ink channel 47. The ink preferably flows through slots or holes etched through a silicon substrate of printhead 30 to its front surface, where a plurality of nozzles and drop-forming transducers, for example, heaters, are situated. When printhead 30 is fabricated from silicon, the drop-forming transducer control circuits 26 can be integrated with the printhead 30. The printhead 30 also includes a deflection mechanism 70 which is described in more detail below with reference to FIGS. 2 and 3.

Figure 2:
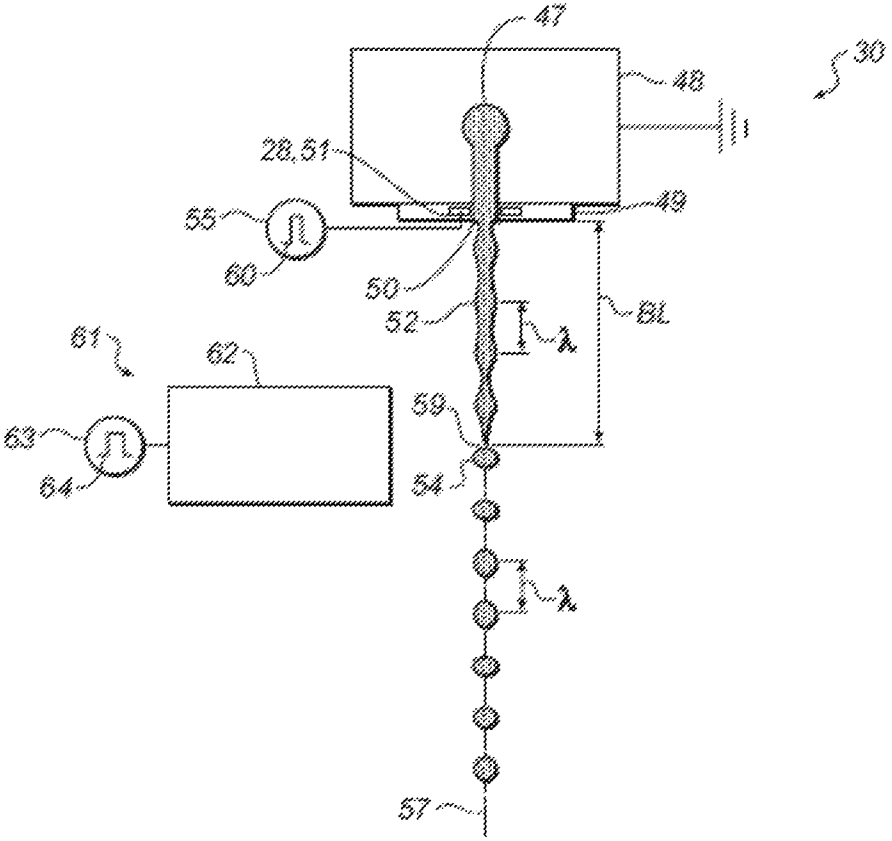
FIG. 2 (Prior Art)
FIG. 2 shows an image of a liquid jet being ejected from a drop generator and its subsequent break off into drops with a regular period.

Referring to FIG. 2, a schematic view of continuous liquid printhead 30 is shown. A jetting module 48 of printhead 30 includes an array of nozzles 50 formed in a nozzle plate 49. In FIG. 2, nozzle plate 49 is affixed to the jetting module 48. Alternatively, the nozzle plate 49 can be integrally formed with the jetting module 48. Liquid, for example, ink, is supplied to the nozzles 50 via ink channel 47 at a pressure sufficient to form continuous liquid streams 52 (sometimes referred to as filaments) from each nozzle 50. In FIG. 2, the array of nozzles 50 extends into and out of the figure.

Jetting module 48 is operable to cause liquid drops 54 to break off from the liquid stream 52 in response to image data. To accomplish this, jetting module 48 includes a drop stimulation or drop-forming transducer 28 (e.g., a heater, a piezoelectric actuator, or an electrohydrodynamic stimulation electrode), that, when selectively activated, perturbs the liquid stream 52, to induce portions of each filament to break off and coalesce to form the drops 54. Depending on the type of transducer used, the transducer can be located in or adjacent to the liquid chamber that supplies the liquid to the nozzles 50 to act on the liquid in the liquid chamber, can be located in or immediately around the nozzles 50 to act on the liquid as it passes through the nozzle, or can be located adjacent to the liquid stream 52 to act on the liquid stream 50 after it has passed through the nozzle 50.

In FIG. 2, drop-forming transducer 28 is a heater 51, for example, an asymmetric heater or a ring heater (either segmented or not segmented), located in the nozzle plate 49 on one or both sides of the nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat.

No. 6,827,429 (Jeanmaire et al.); and U.S. Pat. No. 6,851,796 (Jeanmaire et al.), each of which is incorporated herein by reference.

Typically, one drop-forming transducer 28 is associated with each nozzle 50 of the nozzle array. However, in some configurations, a drop-forming transducer 28 can be associated with groups of nozzles 50 or all of the nozzles 50 in the nozzle array.

Referring to FIG. 2 the printing system has associated with it, a printhead 30 that is operable to produce, from an array of nozzles 50, an array of liquid streams 52. A drop-forming device is associated with each liquid stream 52. The drop-formation device includes a drop-forming transducer 28 and a drop-formation waveform source 55 that supplies a drop-formation waveform 60 to the drop-forming transducer 28. The drop-formation waveform source 55 is a portion of the mechanism control circuits 26. In some embodiments in which the nozzle plate is fabricated of silicon, the drop-formation waveform source 55 is formed at least partially on the nozzle plate 49. The drop-formation waveform source 55 supplies a drop-formation waveform 60, which typically includes a sequence of pulses having a fundamental frequency $f_o$ and a fundamental period of $T_o=1/f_o$, to the drop-formation transducer 28, which produces a modulation in the liquid jet with a wavelength $\lambda$. The modulation grows in amplitude to cause portions of the liquid stream 52 to break off into drops 54. Through the action of the drop-formation device, a sequence of drops 54 is produced. In accordance with the drop-formation waveform 60, the drops 54 are formed at the fundamental frequency $f_o$ with a fundamental period of $T_o=1/f_o$. In FIG. 2, liquid stream 52 breaks off into drops with a regular period at breakoff location 59, which is a distance, called the break off length, BL from the nozzle 50. The distance between a pair of successive drops 54 is essentially equal to the wavelength $\lambda$ of the perturbation on the liquid stream 52. The stream of drops 54 formed from the liquid stream 52 follow an initial trajectory 57.

The break off time of the droplet for a particular printhead can be altered by changing at least one of the amplitude, duty cycle, or number of the stimulation pulses to the respective resistive elements surrounding a respective resistive nozzle orifice. In this way, small variations of either pulse duty cycle or amplitude allow the droplet break off times to be modulated in a predictable fashion within ±one-tenth the droplet generation period.

Also, shown in FIG. 2, is a charging device 61 comprising charging electrode 62 and charging-electrode waveform source 63. The charging electrode 62 associated with the liquid jet is positioned adjacent to the break off point 59 of the liquid stream 52. If a voltage is applied to the charging electrode 62, electric fields are produced between the charging electrode and the electrically grounded liquid jet, and the capacitive coupling between the two produces a net charge on the end of the electrically conductive liquid stream 52. (The liquid stream 52 is grounded by means of contact with the liquid chamber of the grounded drop generator.) If the end portion of the liquid jet breaks off to form a drop while there is a net charge on the end of the liquid stream 52, the charge of that end portion of the liquid stream 52 is trapped on the newly formed drop 54.

Figure 4:
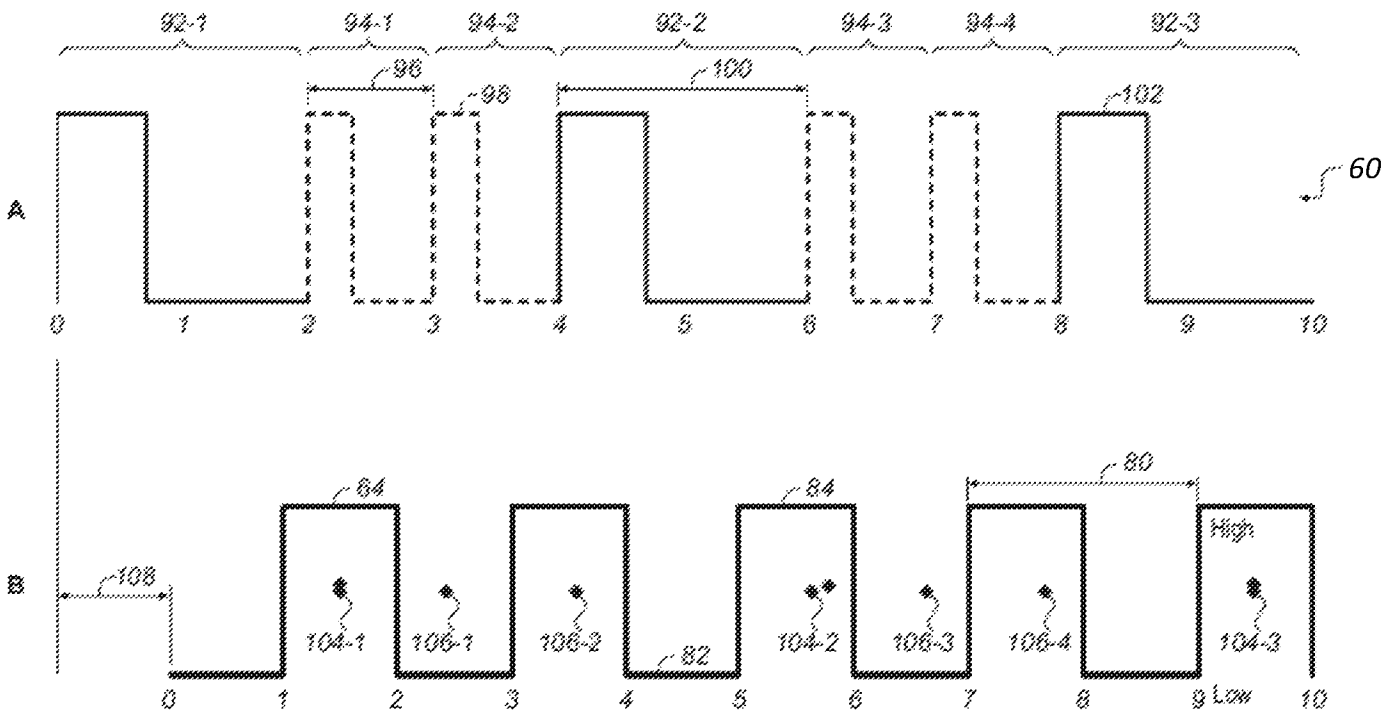
FIG. 4 (Prior Art)
FIG. 4 shows an exemplary timing diagram illustrating drop formation pulses, the charging-electrode waveform, and the break-off of drops.

The voltage on the charging electrode 62 is controlled by the charging-electrode waveform source 63, which provides a charging-electrode waveform 64 operating at a charging-electrode waveform 64 period 80 (shown in FIG. 4). The charging-electrode waveform source 63 provides a varying electrical potential between the charging electrode 62 and the liquid stream 52. The charging-electrode waveform source 63 generates a charging-electrode waveform 64, which includes a first voltage state and a second voltage state; the first voltage state being distinct from the second voltage state. An example of a charging-electrode waveform is shown in part B of FIG. 4. The two voltages are selected such that the drops 54 breaking off during the first voltage state acquire a first charge state and the drops 54 breaking off during the second voltage state acquire a second charge state. The charging-electrode waveform 64 supplied to the charging electrode 62 is independent of, or not responsive to, the image data to be printed. The charging device 61 is synchronized with the drop-formation device using a conventional synchronization device 27, which is a portion of the control circuits 26, (see FIG. 1) so that a fixed phase relationship is maintained between the charging-electrode waveform 64 produced by the charging-electrode waveform source 63 and the clock of the drop-formation waveform source 55. As a result, the phase of the break off of drops 54 from the liquid stream 52, produced by the drop-formation waveforms 92-1, 92-2, 92-3, 94-1, 94-2, 94-3, 94-4 (see FIG. 4), is phase locked to the charging-electrode waveform 64. As indicated in FIG. 4, there can be a phase shift 108, between the charging-electrode waveform 64 and the drop-formation waveforms 92-1, 92-2, 92-3, 94-1, 94-2, 94-3, 94-4.

Figure 3:
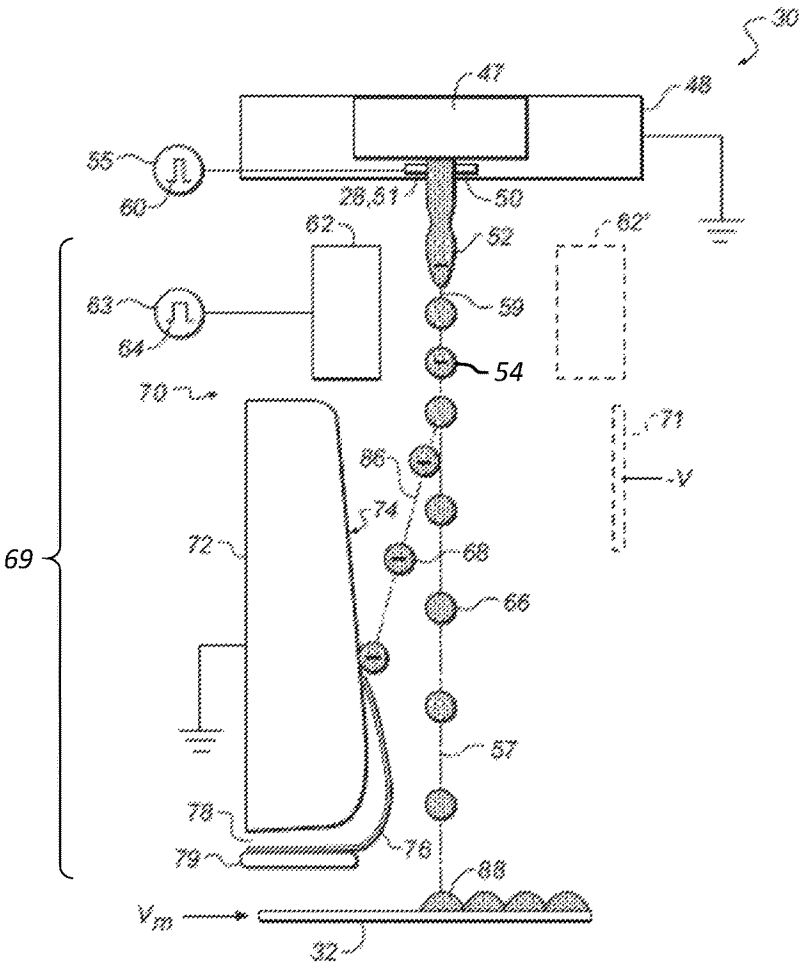
FIG. 3 (Prior Art)
FIG. 3 shows a cross sectional of an inkjet printhead of the continuous liquid ejection system in accordance with the present invention.

With reference now to FIG. 3, printhead 30 includes a drop-forming transducer 28 which creates a liquid stream 52 that breaks up into ink drops 54. Selection of drops 54 as printing drops 66 or non-printing drops 68 will depend upon the phase of the droplet break off relative to the charging electrode voltage pulses that are applied to the to the charging electrode 62 that is part of the deflection mechanism 70, as will be described below. The charging electrode 62 is variably biased by a charging-electrode waveform source 63. The charging-electrode waveform source 63 provides a charging-electrode waveform 64, in the form of a sequence of charging pulses. The charging-electrode waveform 64 is periodic, having a charging-electrode waveform period 80 (FIG. 4).

An embodiment of a charging-electrode waveform 64 is shown in part B of FIG. 4. The charging-electrode waveform 64 comprises a first voltage state 82 and a second voltage state 84. Drops breaking off during the first voltage state 82 are charged to a first charge state and drops breaking off during the second voltage state 84 are charged to a second charge state. The second voltage state 84 is typically at a high level, biased sufficiently to charge the drops 54 as they break off. The first voltage state 82 is typically at a low level relative to the printhead 30 such that the first charge state is relatively uncharged when compared to the second charge state. An exemplary range of values of the electrical potential difference between the first voltage state 82 and a second voltage state 84 is 50 to 300 volts and more preferably 90 to 150 volts.

Returning to a discussion of FIG. 3, when a relatively high level voltage or electrical potential is applied to the charging electrode 62 and a drop 54 breaks off from the liquid stream 52 in front of the charging electrode 62, the drop 54 acquires a charge and is deflected by deflection mechanism 70 towards the ink catcher 72 as non-printing drop 68. The non-printing drops 68 that strike the catcher face 74 form an ink film 76 on the face of the ink catcher 72. The ink film 76 flows down the catcher face 74 and enters liquid channel 78 (also called an ink channel), through which it flows to the ink recycling unit 44. The liquid channel 78 is typically formed between the body of the ink catcher 72 and a lower plate 79.

Deflection occurs when drops 54 break off from the liquid stream 52 while the potential of the charging electrode 62 is provided with an appropriate voltage. The drops 54 will then acquire an induced electrical charge that remains upon the droplet surface. The charge on an individual drop 54 has a polarity opposite that of the charging electrode 62 and a magnitude that is dependent upon the magnitude of the voltage and the coupling capacitance between the charging electrode 62 and the drop 54 at the instant the drop 54 separates from the liquid jet. This coupling capacitance is dependent in part on the spacing between the charging electrode 62 and the drop 54 as it is breaking off. It can also be dependent on the vertical position of the breakoff point 59 relative to the center of the charge electrode 62. After the charged drops 54 have broken away from the liquid stream 52, they continue to pass through the electric fields produced by the charge plate. These electric fields provide a force on the charged drops deflecting them toward the charging electrode 62. The charging electrode 62, even though it cycled between the first and the second voltage states, thus acts as a deflection electrode to help deflect charged drops away from the initial trajectory 57 and toward the ink catcher 72. After passing the charging electrode 62, the drops 54 will travel in close proximity to the catcher face 74 which is typically constructed of a conductor or dielectric. The charges on the surface of the non-printing drops 68 will induce either a surface charge density charge (for a catcher face 74 constructed of a conductor) or a polarization density charge (for a catcher face 74 constructed of a dielectric). The induced charges on the catcher face 74 produce an attractive force on the charged non-printing drops 68. The attractive force on the non-printing drops 68 is identical to that which would be produced by a fictitious charge (opposite in polarity and equal in magnitude) located inside the ink catcher 72 at a distance from the surface equal to the distance between the ink catcher 72 and the non-printing drops 68. The fictitious charge is called an image charge. The attractive force exerted on the charged non-printing drops 68 by the catcher face 74 causes the charged non-printing drops 68 to deflect away from their initial trajectory 57 and accelerate along a non-print trajectory 86 toward the catcher face 74 at a rate proportional to the square of the droplet charge and inversely proportional to the droplet mass. In this embodiment, the ink catcher 72, due to the induced charge distribution, comprises a portion of the deflection mechanism 70. In other embodiments, the deflection mechanism 70 can include one or more additional electrodes to generate an electric field through which the charged droplets pass so as to deflect the charged droplets. For example, an optional single biased deflection electrode 71 in front of the upper grounded portion of the catcher can be used. In some embodiments, the charging electrode 62 can include a second portion on the second side of the jet array, denoted by the dashed line charging electrode 62', which supplied with the same charging-electrode waveform 64 as the first portion of the charging electrode 62.

In the alternative, when the drop-formation waveform 60 applied to the drop-forming transducer 28 causes a drop 54 to break off from the liquid stream 52 when the electrical potential of the charging electrode 62 is at the first voltage state 82 (FIG. 4) (i.e., at a relatively low potential or at a zero potential), the drop 54 does not acquire a charge. Such uncharged drops are unaffected during their flight by electric fields that deflect the charged drops. The uncharged drops therefore become printing drops 66, which travel in a generally undeflected path along the trajectory 57 and impact the print medium 32 to form print dots 88 on the print medium 32, as the recoding medium is moved past the printhead 30 at a speed $V_m$. The charging electrode 62, deflection electrode 71 and ink catcher 72 serve as a drop selection system 69 for the printhead 30.

FIG. 4 illustrates how selected drops can be printed by the control of the drop-formation waveforms supplied to the drop-forming transducer 28. Section A of FIG. 4 shows a drop-formation waveform 60 formed as a sequence that includes three drop-formation waveforms 92-1, 92-2, 92-3, and four drop-formation waveforms 94-1, 94-2, 94-3, 94-4. The drop-formation waveforms 94-1, 94-2, 94-3, 94-4 each have a period 96 and include a pulse 98, and each of the drop-formation waveforms 92-1, 92-2, 92-3 have a longer period 100 and include a longer pulse 102. In this example, the period 96 of the drop-formation waveforms 94-1, 94-2, 94-3, 94-4 is the fundamental period $T_o$, and the period 100 of the drop-formation waveforms 92-1, 92-2, 92-3 is twice the fundamental period, $2T_o$. The drop-formation waveforms 94-1, 94-2, 94-3, 94-4 each cause individual drops to break off from the liquid stream. The drop-formation waveforms 92-1, 92-2, 92-3, due to their longer period, each cause a larger drop to be formed from the liquid stream. The larger drops 54 formed by the drop-formation waveforms 92-1, 92-2, 92-3 each have a volume that is approximately equal to twice the volume of the drops 54 formed by the drop-formation waveforms 94-1, 94-2, 94-3, 94-4.

As previously mentioned, the charge induced on a drop 54 depends on the voltage state of the charging electrode at the instant of drop breakoff. The B section of FIG. 4 shows the charging-electrode waveform 64 and the times, denoted by the diamonds, at which the drops 54 break off from the liquid stream 52. The waveforms 92-1, 92-2, 92-3 cause large drops 104-1, 104-2, 104-3 to break off from the liquid stream 52 while the charging-electrode waveform 64 is in the second voltage state 84. Due to the high voltage applied to the charging electrode 62 in the second voltage state 84, the large drops 104-1, 104-2, 104-3 are charged to a level that causes them to be deflected as non-printing drops 68 such that they strike the catcher face 74 of the ink catcher 72 in FIG. 3. These large drops may be formed as a single drop (denoted by the double diamond for 104-1), as two drops that break off from the liquid stream 52 at almost the same time that subsequently merge to form a large drop (denoted by two closely spaced diamonds for 104-2), or as a large drop that breaks off from the liquid stream that breaks apart and then merges back to a large drop (denoted by the double diamond for 104-3). The waveforms 94-1, 94-2, 94-3, 94-4 cause small drops 106-1, 106-2, 106-2, 106-3, 106-4 to form. Small drops 106-1 and 106-3 break off during the first voltage state 82, and therefore will be relatively uncharged; they are not deflected into the ink catcher 72, but rather pass by the ink catcher 72 as printing drops 66 and strike the print media 32 (see FIG. 3). Small drops 106-2 and 104-4 break off during the second voltage state 84 and are deflected to strike the ink catcher 74 as non-printing drops 68. The charging-electrode waveform 64 is not controlled by the pixel data to be printed, while the drop-formation waveform 60 is determined by the print data. This type of drop deflection is known and has been described in, for example, U.S. Pat. No. 8,585,189 (Marcus et al.); U.S. Pat. No. 8,651,632 (Marcus); U.S. Pat. No. 8,651,633 (Marcus et al.); U.S. Pat. No. 8,696,094 (Marcus et al.); and U.S. Pat. No. 8,888,256 (Marcus et al.), each of which is incorporated herein by reference.

Figure 5:
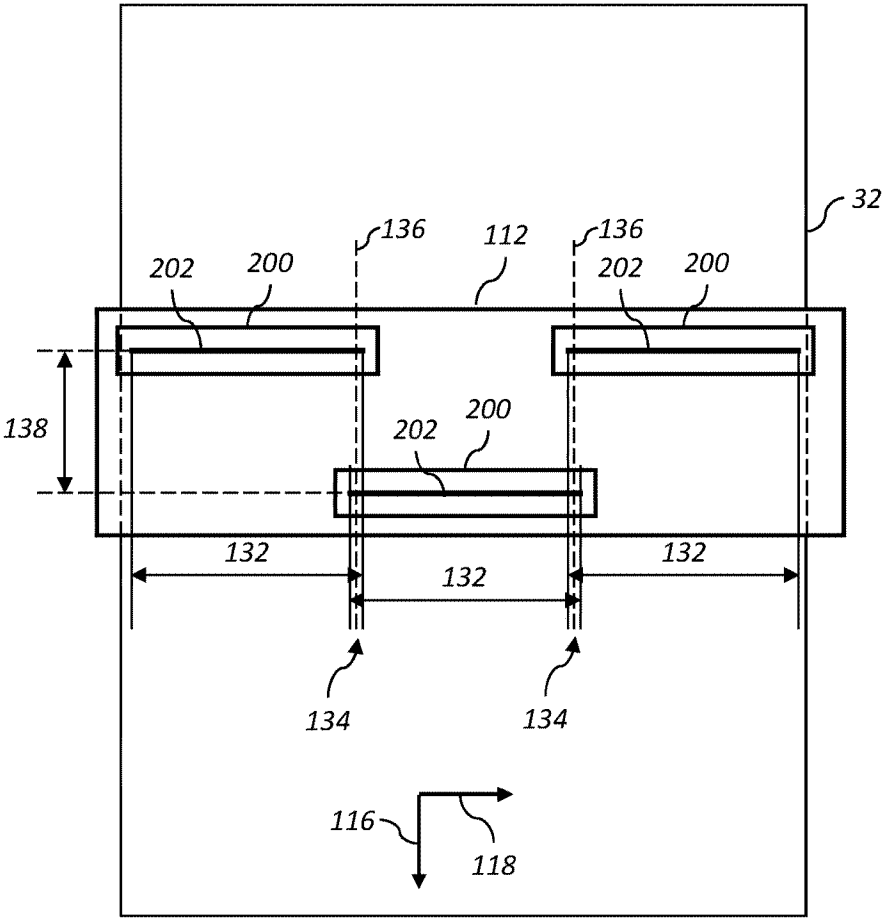
FIG. 5 (Prior Art)
FIG. 5 shows a top view of an exemplary printhead assembly including a staggered array of jetting modules.

FIG. 5 shows a diagram of an exemplary inkjet printhead assembly 112. The printhead assembly 112 includes a plurality of jetting modules 200 arranged across a width dimension of the print medium 32 in a staggered array configuration. The width dimension of the print medium 32 is the dimension in cross-track direction 118, which is perpendicular to in-track direction 116 (i.e., the motion direction of the print medium 32). Such printhead assemblies 112 are sometimes referred to as "lineheads."

Each of the jetting modules 200 includes a plurality of inkjet nozzles arranged in nozzle array 202, and is adapted to print a swath of image data in a corresponding printing region 132. Commonly, the jetting modules 200 are arranged in a spatially-overlapping arrangement where the printing regions 132 overlap in overlap regions 134. Each of the overlap regions 134 has a corresponding centerline 136. In the overlap regions 134, nozzles from more than one nozzle array 202 can be used to print the image data.

Stitching is a process that refers to the alignment of the printed images produced from jetting modules 200 for the purpose of creating the appearance of a single page-width line head. In the exemplary arrangement shown in FIG. 5, three printheads 200 are stitched together at overlap regions 134 to form a page-width printhead assembly 112. The page-width image data is processed and segmented into separate portions that are sent to each jetting module 200 with appropriate time delays to account for the staggered positions of the jetting modules 200. The image data portions printed by each of the jetting modules 200 is sometimes referred to as "swaths." Stitching systems and algorithms are used to determine which nozzles of each nozzle array 202 should be used for printing in the overlap region 134. Preferably, the stitching algorithms create a boundary between the printing regions 132 that is not readily detected by eye. One such stitching algorithm is described in commonly-assigned U.S. Pat. No. 7,871,145 to Enge, which is incorporated herein by reference.

The two lines of nozzle arrays 202 in the staggered arrangement are separated by a nozzle array spacing 138. It has been found that larger nozzle array spacing 138 result in large amplitudes of the stitching variation, even after stitching correction algorithms are applied. Therefore, it is desirable to reduce the nozzle array spacing 138 as much as possible. With prior art arrangements for mounting the nozzle arrays 202, such as that described in the aforementioned, commonly-assigned U.S. Pat. No. 8,226,215 to Bechler et al. there is a limit to how small the nozzle array spacing 138 can be. These methods also get expensive and cumbersome when it is necessary to use increasing numbers of jetting modules in the line head to accommodate larger and larger print widths. These limitations are addressed with the modular inkjet printhead assembly illustrated in FIG. 6.

Figure 6:
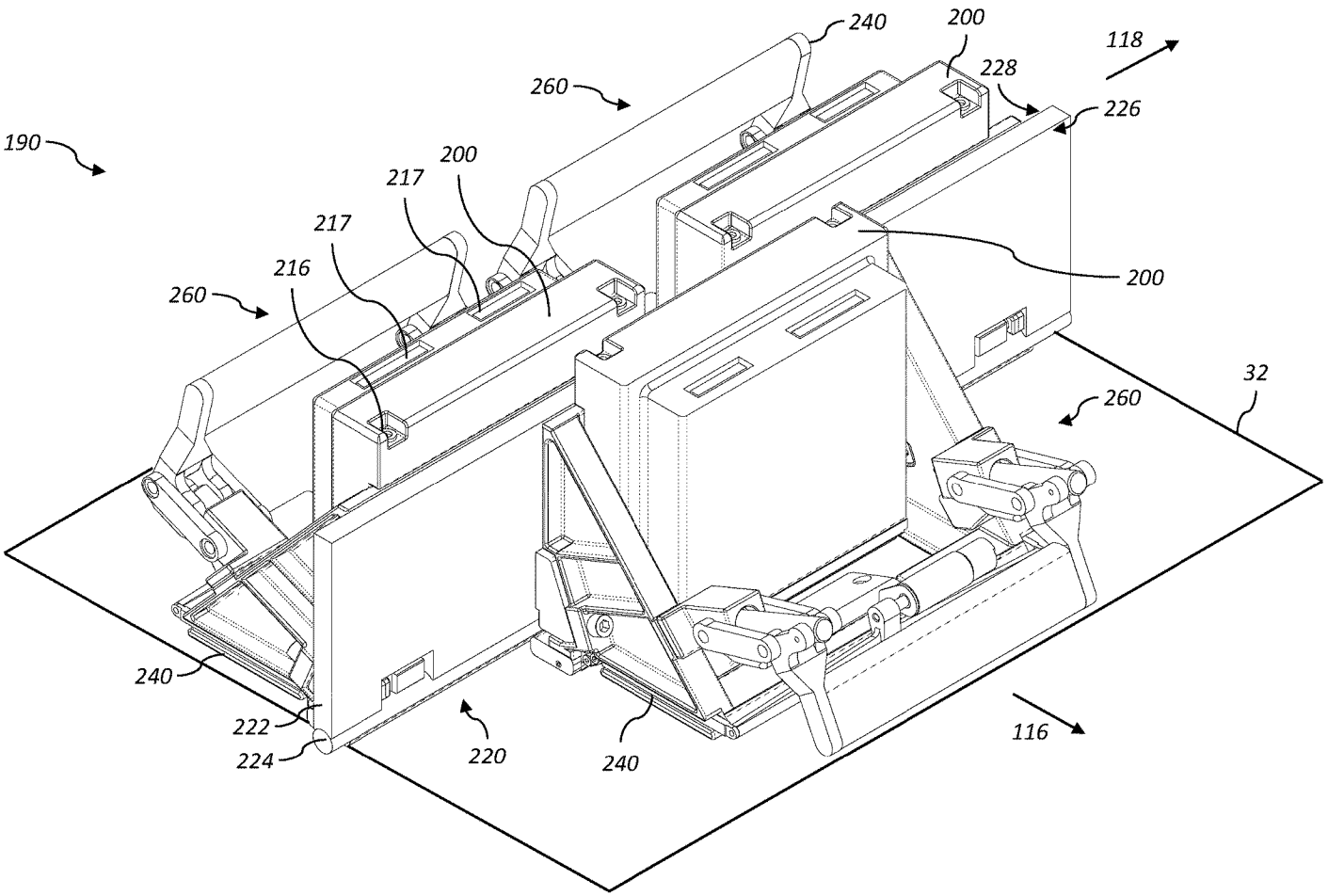
FIG. 6 (Prior Art)
FIG. 6 shows an exemplary modular printhead assembly including a plurality of printhead modules mounted onto a central rail assembly in accordance with an exemplary embodiment.

FIG. 6 shows an exemplary modular printhead assembly 190 including a plurality of printhead modules 260 in accordance with the present invention. More details about such modular printhead assemblies can be found in commonly-assigned U.S. Pat. No. 9,527,319 to Brazas et al., U.S. Pat. No. 9,566,798 to Tunmore et al., U.S. Pat. No. 9,623,689 to Piatt et al., and U.S. patent application Ser. No. 15/590,070 to Tunmore et al., each of which is incorporated herein by reference. In the configuration of FIG. 6, each printhead module 260 includes a jetting module 200 and a mounting assembly 240. The printhead modules 260 are mounted onto a central rail assembly 220, which includes a rod 224 attached onto the print-medium-facing side of a beam 222 that faces the print medium 32. The print medium 32 moves past the printhead assembly 190 in an in-track direction 116. The rail assembly 240 extends across the width of a print zone on the print medium 32 in a cross-track direction 118. The print zone corresponds to the portion of the print medium 32 onto which the printhead assembly 190 is adapted to print.

In the illustrated configuration, the printhead assembly 190 includes three printhead modules 260, with one being mounted on a downstream side 226 of the beam 222, and two being mounted on an upstream side 228 of the beam 222. An advantageous feature of this modular printhead assembly 190 design is that wider print media 32 can be supported by simply extending the length of the rail assembly 220 and adding additional printhead modules 260. By alternating the printhead modules 260 between the downstream side 226 and the upstream side 228 of the beam 222, the associated nozzle arrays 202 can be stitched together with appropriate overlap regions 134 (see FIG. 5).

Fluid system connectors 216 and electrical connectors 217 are provided for each of the printhead modules 260 to make connections with external system components. While not shown in FIG. 6, there are fluid system components and control electronics associated with each printhead module 260, which are ideally located within the linehead close to their associated printhead module 260. These include ink pressure sensors, ink temperature sensors, fluid control valves, air flow sources and their associated sensors and control electronics, charging-electrode waveform sources and short detection sensors, drop-formation waveform sources, and memory units for storing printhead operating parameters and reliability data.

As new applications are being developed for the use of high speed inkjet printing technology, such as the printing of labels, books and magazines, packaging materials, and décor (such as wallpaper, and laminate material for flooring and countertops), there is a need to develop an increasing variety of linehead configurations to accommodate the increasing number of desired print widths. To simplify the development of the various lineheads, it is desirable to employ a modular design architecture for printhead alignment hardware and the supporting fluid and electronic hardware. In an exemplary architecture, each of the modular printhead assemblies 190 is designed to accommodate three printhead modules 260 along with their supporting fluid and electrical hardware. By combining different numbers of modular printhead assemblies 190 together, lineheads having different print widths can be created as illustrated in FIGS. 7-11. Depending on the application, the modular printhead assemblies 190 can be depopulated to include only one or two printheads, as is shown in FIG. 9.

Figure 7:
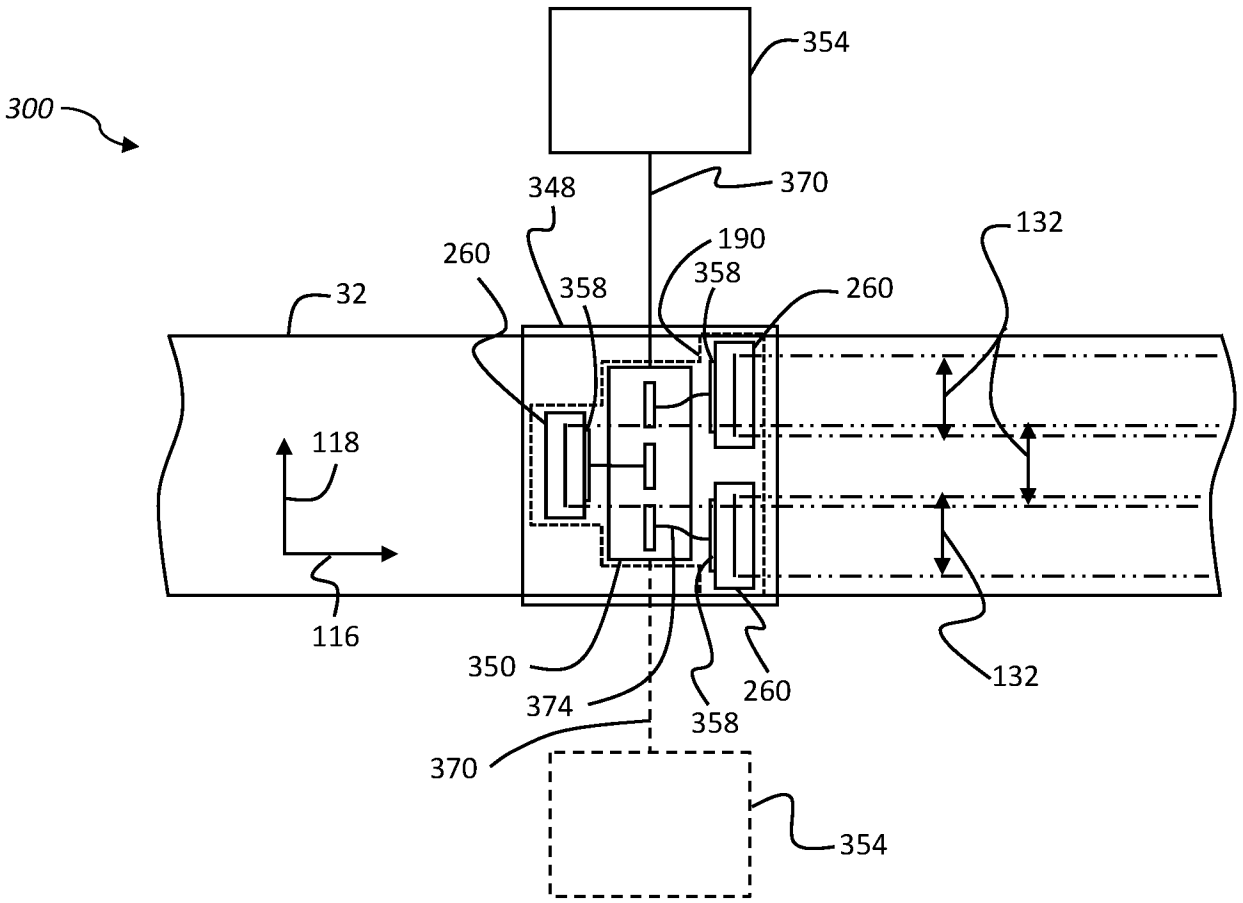
FIG. 7 shows an exemplary linehead including a single modular printhead assembly positioned over a web of print media.

FIGS. 7-11 each show a production printing system 300 having a linehead 348 with one or more modular printhead assemblies 190 positioned over a web of print media 32. In FIG. 7, the linehead 348 includes a single modular printhead assembly 190 with three printhead modules 260. Each printhead module 260 prints a separate swath of image data in a corresponding printing region 132 on the print medium 32 as the print medium 32 is transported past the linehead 348.

Figure 8:
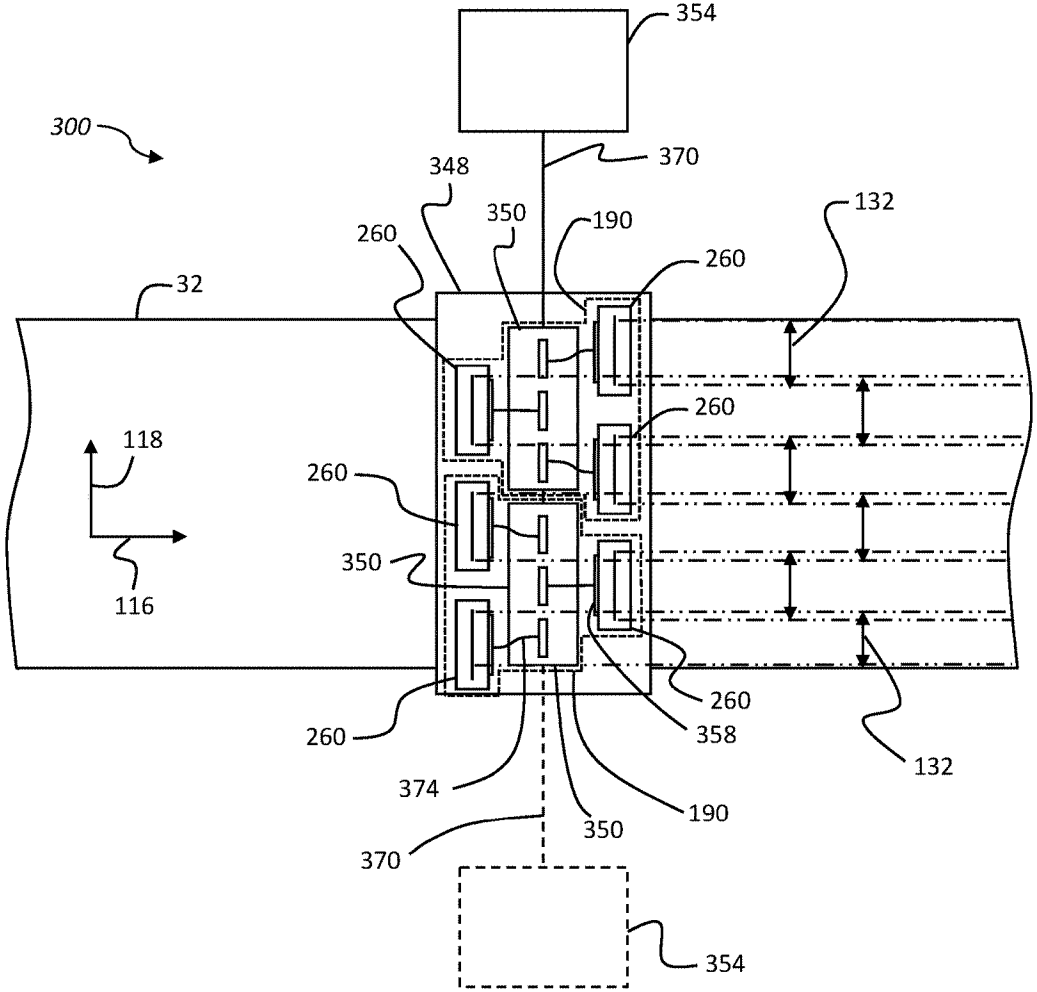
FIG. 8 shows an exemplary linehead including two modular printhead assemblies positioned over a web of print media.
Figure 9:
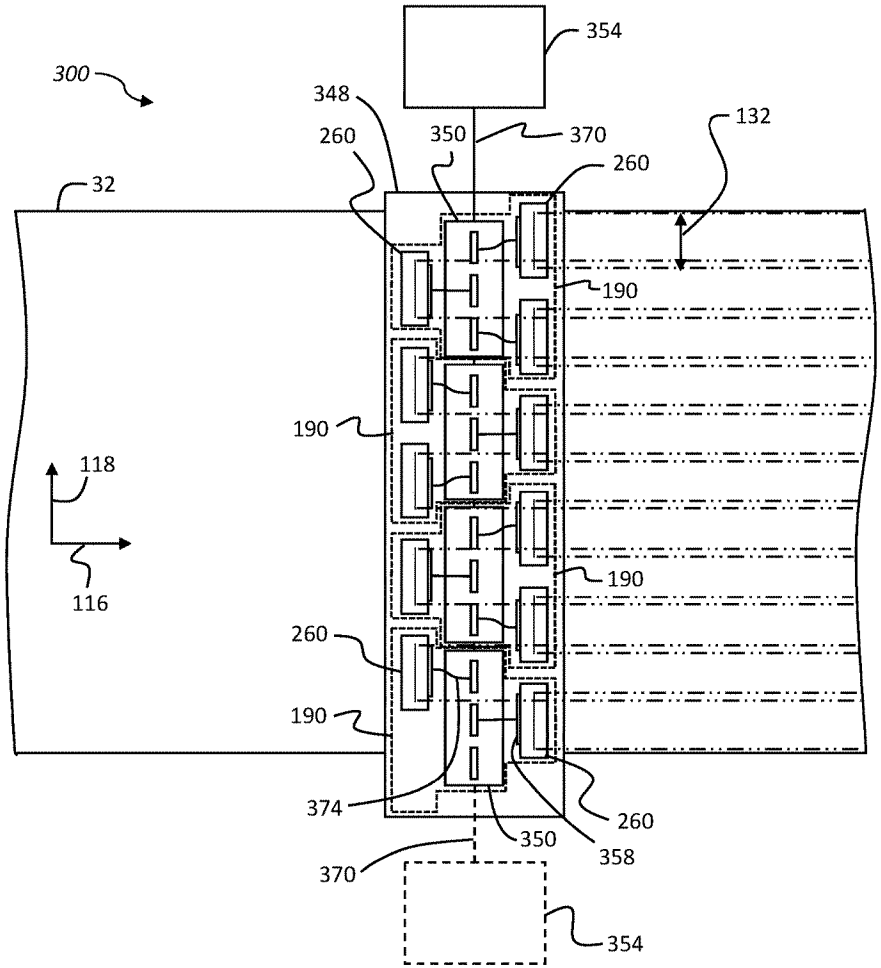
FIG. 9 shows an exemplary linehead including four modular printhead assemblies positioned over a web of print media, with one of the modular printhead assemblies not being completely populated with printhead modules.

In FIG. 8, the linehead 348 includes two modular printhead assemblies 190; one with two printhead modules 260 on the downstream side and one on the upstream side, and the other modular printhead assembly 190 having one printhead module 260 on the downstream side and two printhead modules 260 on the upstream side.

The linehead 348 of FIG. 9 includes four modular printhead assemblies 190, three of the modular printhead assemblies 190 each have three printhead modules 260, and a fourth modular printhead assembly 190 (the bottommost one in the figure) is populated with only two printhead modules 260 instead of the normal three printhead modules 260.

Figure 10:
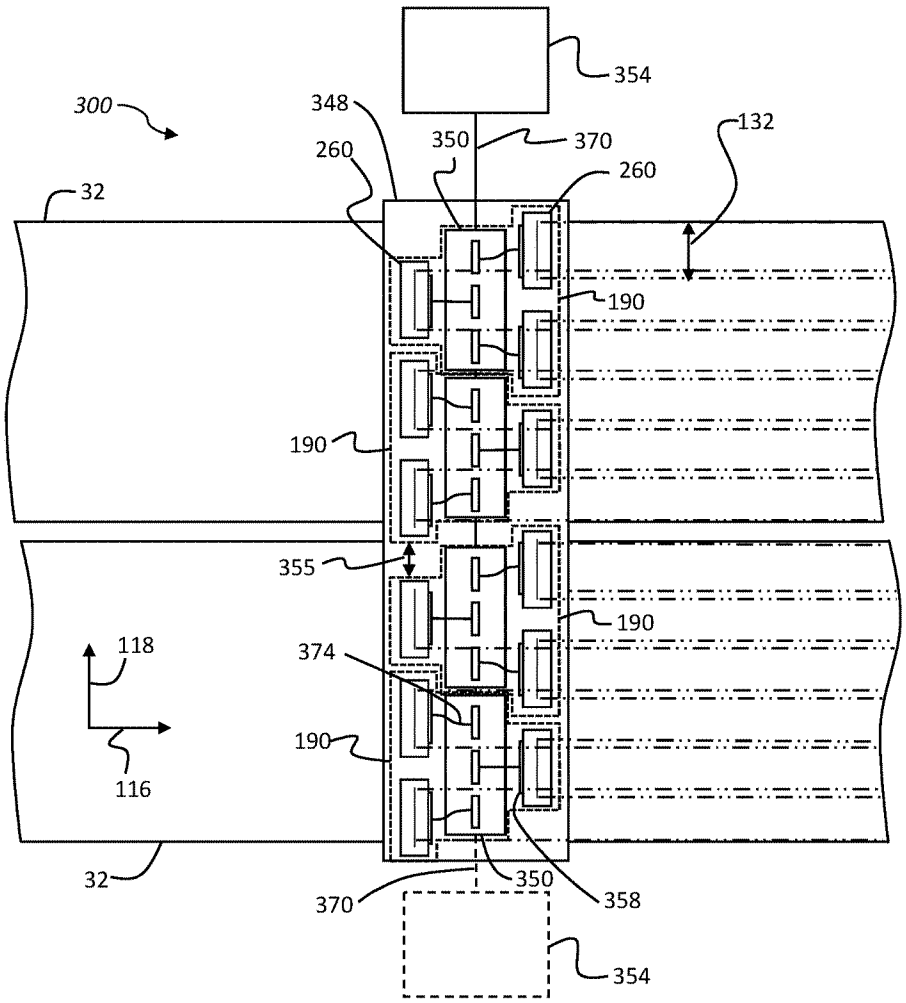
FIG. 10 shows an exemplary linehead including four modular printhead assemblies positioned over a web of print media, with an increased spacing between the center two modular printhead assemblies.

The linehead 348 of FIG. 10 has four modular printhead assemblies 190, in which the cross-track spacing 355 between the center two modular printhead assemblies 190 has been increased to enable the linehead 348 to print on two side-by-side webs of print media 32. In some embodiments of FIG. 10, the side-by-side webs of media can comprise a first pass and a second pass of the same print media 32, with the media being laterally shifted, and possibly inverted, between the first and the second passes, as is disclosed in commonly-assigned U.S. Pat. No. 6,050,191 to Enderle et al., which is incorporated herein by reference.

Figure 11:
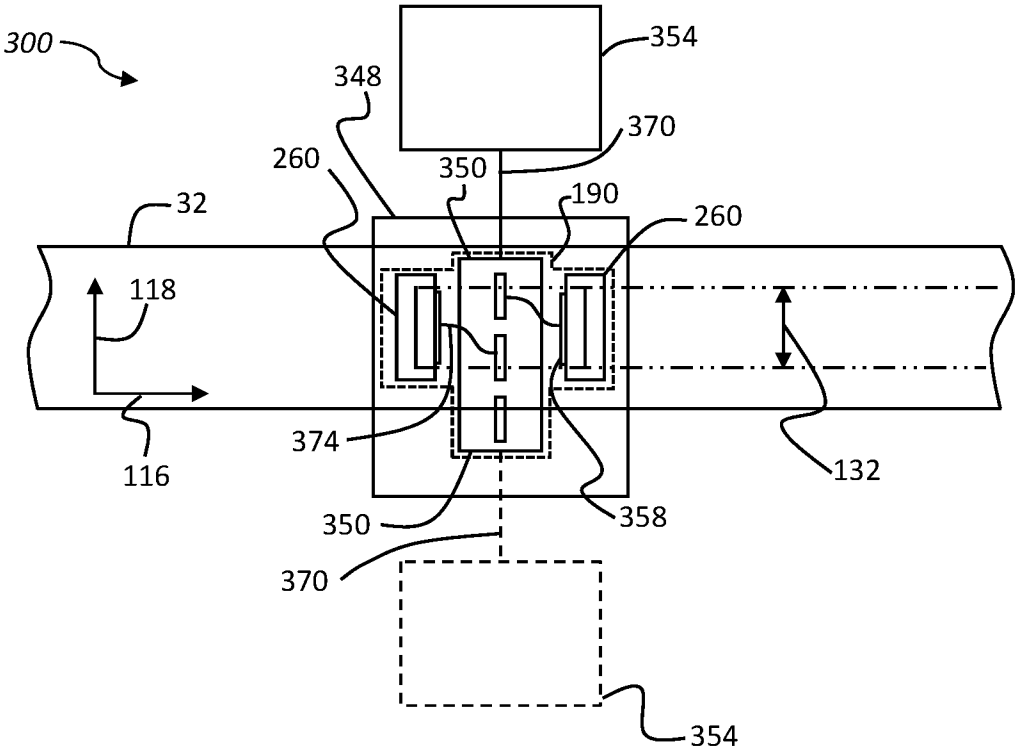
FIG. 11 shows an exemplary linehead including a single modular printhead assembly positioned over a web of print media, the modular printhead assembly having two printhead modules aligned to print on the same print swath.

FIG. 11 shows a linehead 348 having a single modular printhead assembly 190. In this embodiment, the printing regions 132 of the two printhead modules 260 totally overlap each other. As disclosed in commonly-assigned U.S. application Ser. No. 15/590,070, filed May 9, 2017, which is incorporated herein by reference, such a configuration can be used to double the print speed of a single printhead printing system, double the in-track resolution, or to print with two different ink colors.

In each of the configurations in FIGS. 7-11, a system controller 354 is connected to a first end of the linehead 348. Alternatively, the system controller 354 could be connected to the second end of the linehead 354, as indicated dashed line system controller 354.

In keeping with the modular printhead assembly architecture, the fluid system components associated with each printhead module 260 are preferably configured as fluid component modules, where each fluid component module is positioned in close proximity to the corresponding printhead module 260. Similarly, the electronic components associated an individual printhead module 260 are preferably located on one or more electronics boards within the modular printhead assembly 190. Accordingly, in the illustrated embodiment, each modular printhead assembly 190, which can include up to three printhead modules 260, includes a fluid component module and printhead electronics boards (PHE) 358 for each printhead module 260.

As a linehead 348 can include from one to eight or more modular printhead assemblies 190, each with one to three printhead modules 260 and associated printhead electronics boards 358, an efficient method must be provided to enable the system controller 354 to communicate with the printhead electronics board 358 associated with a particular printhead module 260 for all the possible linehead configurations. To facilitate communicating with the individual printhead electronic boards 358 within the linehead 348 and distribution of power to the printhead modules 260, each modular printhead assembly 190 includes a power communication distribution board (PCD) 350 through which power and communication are provided to the one or more electronics boards associated with an individual printhead modules 260, as shown in FIGS. 7-11, and more clearly in the schematic block drawing of FIG. 12. The power communication distribution board 350 is sometimes referred to as communication distribution device.

Each power communication distribution board 350 has two primary communication ports 352 (a first primary communication port 352A and a second primary communication port 352B) through which it can be connected to other power communication distribution boards 350, or to the system controller 354. In the illustrated configuration, each power communication distribution board 350 also has three secondary communication ports 356 through which communication and power can pass to secondary devices 364 (e.g., the individual printhead electronics boards 358). The secondary communication ports 356 are arranged on the PCD 350 in a defined order (i.e., A, B and C starting nearest to the first primary communication port 352A). The communication via the PCD 350 with each PHE 358 does not include print data. The high data-rate print data are supplied directly to the PHEs 358 by a print data source 366 via optical fibers 368.

Figure 12:
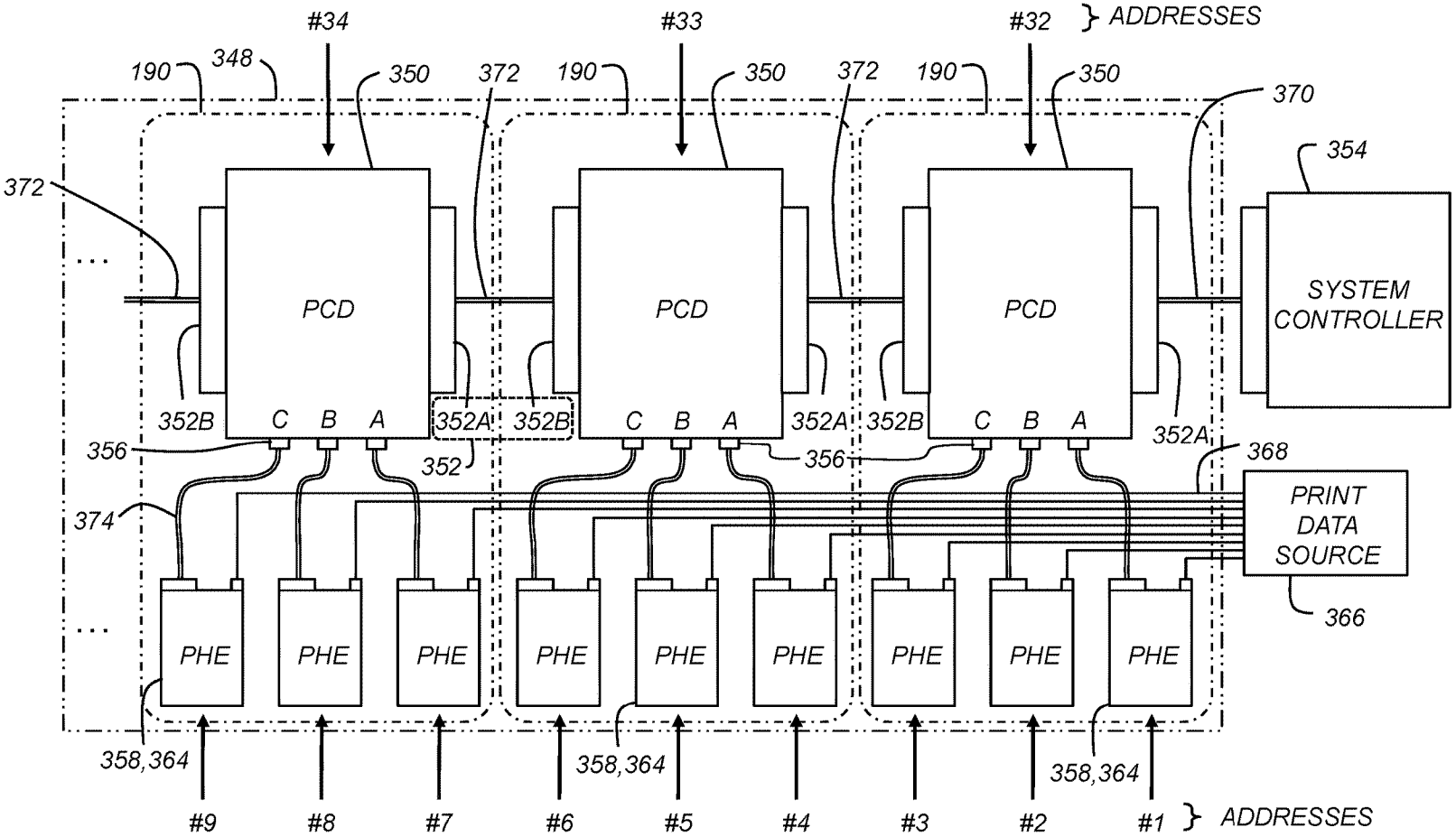
FIG. 12 shows a block diagram of exemplary linehead electronics with a plurality of communication distribution devices and attached secondary devices, a system controller being connected to the rightmost communication distribution device.

The exemplary configuration of FIG. 12 shows a linehead 348 that includes a plurality of modular printhead assemblies 190 connected to a system controller 354. Each of the modular printhead assemblies 190 include a power communication distribution board 350 and three printhead electronic boards 358, each of the printhead electronic boards 358 being associated with a corresponding printhead module 260 (FIGS. 7-11).

The system controller 354 is connected by an umbilical cable 370 to the first primary communication port 352A of a first PCD 350 in the linehead 348. The second primary communication port 352B of the first PCD 350 is connected by a primary cable 372 to the first primary port 352A of a second PCD 350. Similarly, additional primary cables 372 connect the adjacent primary communication ports 352 of adjacent PCDs 350. In this manner, the PCDs 350 within the linehead 348 are connected to each other in a daisy chain arrangement to form a connected sequence of PCDs 350, with a first PCD 350 (i.e., the rightmost PCD 350 in the illustrated configuration) being connected to the system controller 354.

Each PHE 358 (also referred to as secondary device 364), which is located in proximity to a corresponding secondary communication port 356 of the associated PCD 350, is connected to the adjacent secondary port 356 via a secondary cable 374.

Figure 13:
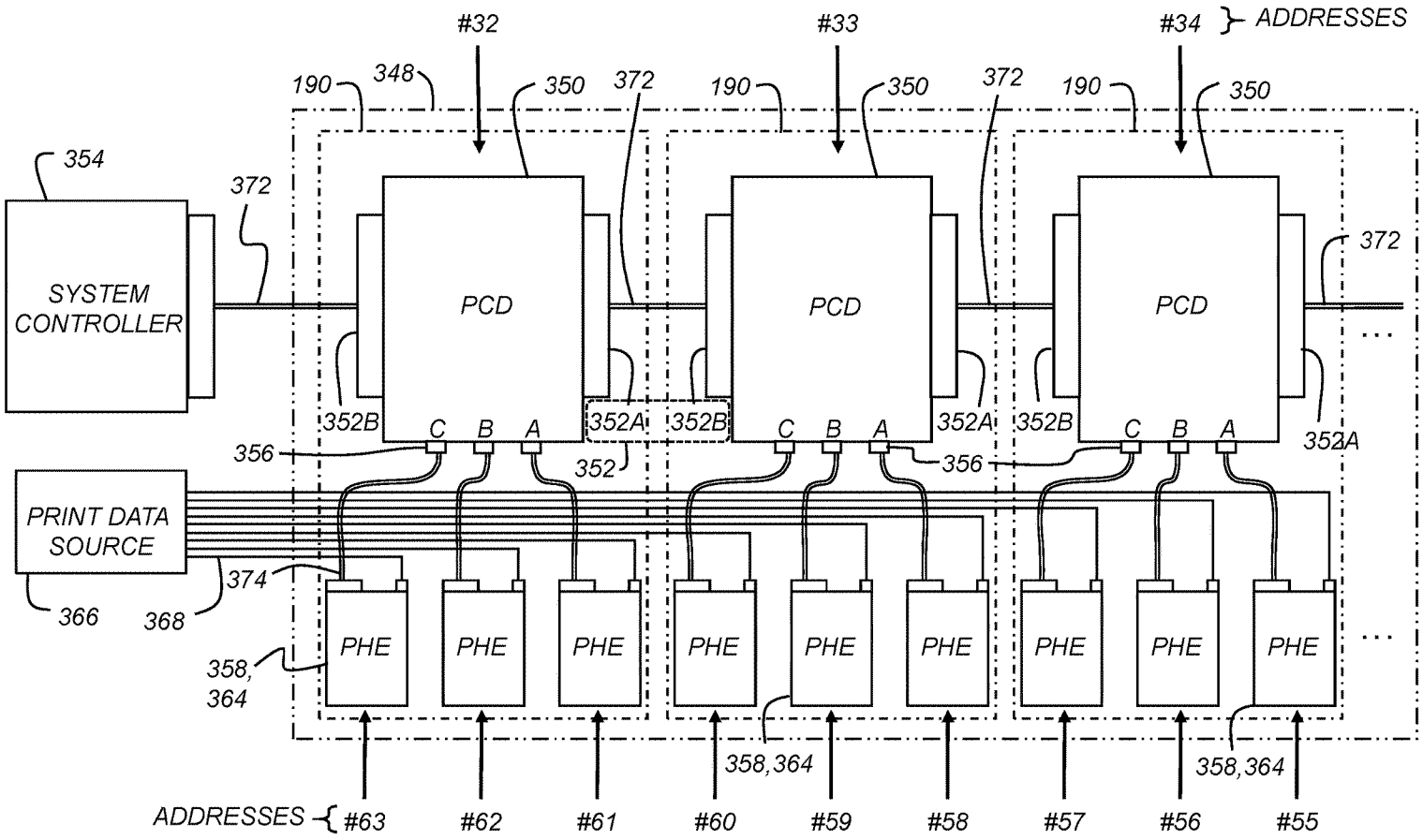
FIG. 13 shows a block diagram of the exemplary linehead electronics with a plurality of communication distribution devices and attached secondary devices, a system controller being connected to the leftmost communication distribution device.

Communication between the system controller 354 and the PCDs 350 and the PHE 358 are via serial links included in the umbilical cable 370, the primary cables 372 and the secondary cables 374. To facilitate communications using the serial links, each device (i.e., each PCD 350 and each PHE 358) must be assigned a distinct communication address. In the printing system environment, it is important that the system controller 354 know, for each of the PHEs 358, the printhead position or print swath position for the associated printhead module 260. To facilitate this, the present invention provides a method for assigning communication addresses to the printhead electronics (i.e., the PHEs 358) in an order that is clearly linked to the physical position of the printhead modules 260. It does this independent of whether the system controller 254 is connected to the rightmost PCD 250 in the connected sequence of PCDs as shown in FIG. 12, or to the leftmost PCD 250 as shown in FIG. 13. This enables the modular architecture to be used in a large variety of linehead configurations.

The process for assigning communication addresses is carried out each time the printing system 300 is powered on. At power on, each of the PCDs 350 within the linehead 348 detect whether it is the PCD 350 at an end of the linehead 348 that is directly connected to the system controller 354, whether it is the PCD 350 at the opposite end of the linehead 348 from the system controller 354 with one of its primary communication ports 352 not connected to anything, or whether it is a PCD 350 somewhere between the two ends. The PCD 350 that is directly connected via the umbilical cable 370 to the system controller 354 also determines whether the system controller 354 is connected to the first primary communication port 352A or to the second primary communication port 352B. Each PCD 350 also determines whether secondary devices 364 are attached to any of its secondary communication ports 356. The process by which a PCD 350 detects attached devices will be described later.

The communication addresses that can be assigned to the PCDs 350 and to the secondary devices 364 (e.g., the PHEs 358) come from separate pools or sets of addresses. The first set of communication address consists of addresses that can be assigned to the individual communications distribution devices (i.e., the PCDs 350). These addresses have a prescribed order, typically a consecutive number order. In an exemplary embodiment, the first set of communication address has address values ranging from #32 to #39. (For clarity in this description, address values will be denoted with a "#" sign prefix to distinguish them from drawing reference numbers.)

The second set of communication addresses, which is distinct from the first set of communication addresses, are those that can be assigned to the individual secondary devices 364. These addresses will also have prescribed order, typically a numeric order. In an exemplary embodiment, the second set of communication addresses includes two subsets of communication addresses: the first subset includes the values ranging from #1 to #24, and the second subset includes the values ranging from #40 to #63.

The PCD 350 that is connected to the system controller 354 can be referred to as the first communication distribution device or the first PCD 350. Upon detecting that it is connected directly to the system controller 354, the first PCD 350 assigns itself the first address in the first set of communication addresses (i.e., the address #32). This assignment to the first PCD 350 of the first communication address in the first set of communication addresses is independent of whether the system controller is attached to the first primary communication port 352A or the second primary communication port 352B. However, the assignment of the communication addresses for the attached secondary devices 364 preferably depends on which primary communication port 352 is connected to the system controller 354.

If the system controller 354 is connected to the first primary communication port 352A of the first PCD 350, then first PCD 350 will assign the first (lowest) address in the second set of communication addresses to the secondary device 364 (i.e., the PHE 358) attached to the secondary port 356 closest to the first primary communication port 352A. This lowest communication address of the second set of communication addresses is #1 in the exemplary embodiment. Continuing along the sequence of secondary communication ports, the first PCD 350 sequentially assigns communication addresses in ascending order (i.e., #2 and #3) to the other secondary devices 358 (i.e., the PHEs 358) attached to the B and C secondary communication ports 356.

On the other hand, if the system controller 354 is connected to the second primary communication port 352B of the leftmost PCD 350 as shown in FIG. 13, then the leftmost PCD 350 will be designated to be the first PCD 350. As before, the first PCD 350 will assign itself the lowest address in the first set of communication addresses (i.e., address #32). The first PCD 350 will then assign the last (highest) address in the second set of communication addresses to the secondary device 364 (i.e., the PHE 358) attached to the secondary port 356 closest to the second primary communication port 352B that is connected to the system controller 354 (i.e., port C). This highest communication address of the second set of communication addresses is address #63 in the exemplary embodiment. Continuing along the C-B-A sequence of secondary communication ports 356, the first PCD 350 sequentially assigns communication addresses in a descending sequence to the secondary devices 364 attached to the B and A secondary communication ports 356.

As the PCD 350 is assigning communication addresses to the secondary devices 364, the communication addresses are allocated sequentially, either upward or downward, based on the order of the secondary communication ports 356. If any of the secondary communication ports 356 are open (i.e., it is detected that they don't have an attached secondary device 364), the communication address is held in reserve for allocation to a secondary device 364 that is attached to that secondary communication port 356 at a later time. If a secondary device 364 is subsequently attached to that open secondary communication port 356, the communication address held in reserve can be assigned to that secondary device 364 without needing to reassign communication addresses to the other attached secondary devices 364. After assigning communication addresses to itself and to the attached secondary devices 364, the first PCD 350 creates a table of assigned communication address for subsequent transmission to the system controller 354. On the other hand, after the communication addresses have been assigned, if one of the secondary devices 364 is disconnected from a secondary communication port 356, the communication address that had been assigned to the removed secondary device 364 is unassigned by the PCD 350, but is held in reserve so that it can be reassigned to any secondary device 364 that is later attached to that secondary communication port 356.

After assigning communication addresses to itself and to the attached secondary devices 364, the first PCD 350 communicates address information to the next PCD 350 in the connected sequence of PCDs 350 via one of its primary communication ports 352. In an exemplary embodiment, the address information communicated to the next PCD 350 specifies next communication address in the prescribed sequence of the first set of communication addresses (which the next PCD 350 can assign to itself) and also specifies the next available communication address in the prescribed sequence of the second set of communication addresses that the next PCD 350 can assign to the secondary devices 364 connected to it.

For example, consider the case where the first PCD 350 is connected to the system controller 354 using the first primary communication port 352A as in FIG. 12. The first PCD 350 would assign itself communication address #32, and would notify the next PCD 350 in the connected sequence that next available address in the first set of communication addresses is #33. And if the first PCD 350 has three secondary communication ports 356 which were assigned communication addresses #1-#3 from the first subset of the second set of communication addresses, then the first PCD 350 would notify the next PCD 350 that the next available communication address in the first subset of the second set of communication addresses is #4.

If, on the other hand, the first PCD 350 is connected to the system controller 354 using the second primary communication port 352B, then it would have assigned the communication address #63-#61 from the second subset of the second set of communication addresses to its attached secondary devices 364. In this case, the first PCD 350 would notify the next PCD 350 that the next available communication address from the second subset of the second set of communication addresses is address #60.

Upon being notified as to the next available communication address in both the first and the second sets of communication addresses, the next PCD 350 in the connected sequence would in a similar manner assign the received next available communication address in the first set of communication addresses to itself, and would sequentially assign the next available addresses in the second set of communication addresses to the secondary devices 364 attached to its sequence of secondary communication ports 356. If the next available communication addresses were received through the first primary communication port 352A (as in FIG. 12), then the PCD 350 will increment the communication address for each subsequent secondary device 364. However, if the communication addresses were received through the second primary communication port 352B (as in FIG. 13), then the PCD 350 will decrement the communication address for each subsequent secondary device 364. Alternately, the PCD 350 can determine whether to increment or decrement the communication address for each subsequent secondary device based on whether the next available address is in the first or second subsets of the second set of communication addresses. If the next available address is in the first subset of the second set of communication addresses, then the communication addresses are incremented, and if the next available address is in the second subset of the second set of communication addresses, then the communication addresses are decremented.

After assigning communication addresses to itself and to its attached secondary devices 364, the PCD 350 creates a table of assigned communication address for subsequent transmission to the system controller 354 and continues the process of assigning communication addresses by communicating the next available communication addresses to the next PCD 350 in the connected sequence. This process continues until the last PCD 350 in the connected sequence is reached, in which case the process is terminated since communication addresses have been assigned all of the PCDs 350 and their connected secondary devices 364.

As each PCD 350 assigns communication addresses to itself and to its attached secondary devices 364, it notifies the system controller 354 that it has completed the assignment of communication addresses. The system controller 354 can then send a query to the PCD 354 to have it transmit its address assignment table to the system controller 354. Upon receipt of the address assignment tables from each of the PCDs 350, the system controller can begin communicating with any of the devices (the PCDs 350 and PHEs 358) for which it has received a communications address.

After the communication addresses are assigned to all the connected devices in this manner, each of the PCDs 350 continues to monitor the connection status at each of its communication ports (i.e., primary communication ports 352 and secondary communication ports 356). If there is any change in the connection status due to a new device being connected or a device being removed, the PCD will assign the reserved communication address to the new device, or it will un-assign the communication address of the removed device. The PCD 350 will then notify the system controller 354 of the altered communication address table.

This method of assigning the communication addresses to the secondary devices ensures that the communication addresses are always incremented in the same direction relative to the linehead independent of which end of the linehead the system controller is attached to. That is, the communication addresses of the secondary devices 364 (i.e., the PHEs 358) always increase from right-to-left across the linehead 348.

In an exemplary embodiment of the invention, the second set of communication addresses includes two distinct subsets of communication addresses. The communication address in one of the subsets are used when the successively assigned communication address are incremented upward, while the communication addresses in the second subset are used when the successively assigned communication address are decremented downward. The use of these two distinct subsets of communication addresses can help the PCDs 350 downstream of the first PCD 350 to determine whether they are to increment or decrement the communication addresses from the received next available communication address as they assign the second set of communication addresses to the attached secondary devices 364.

Figure 14:
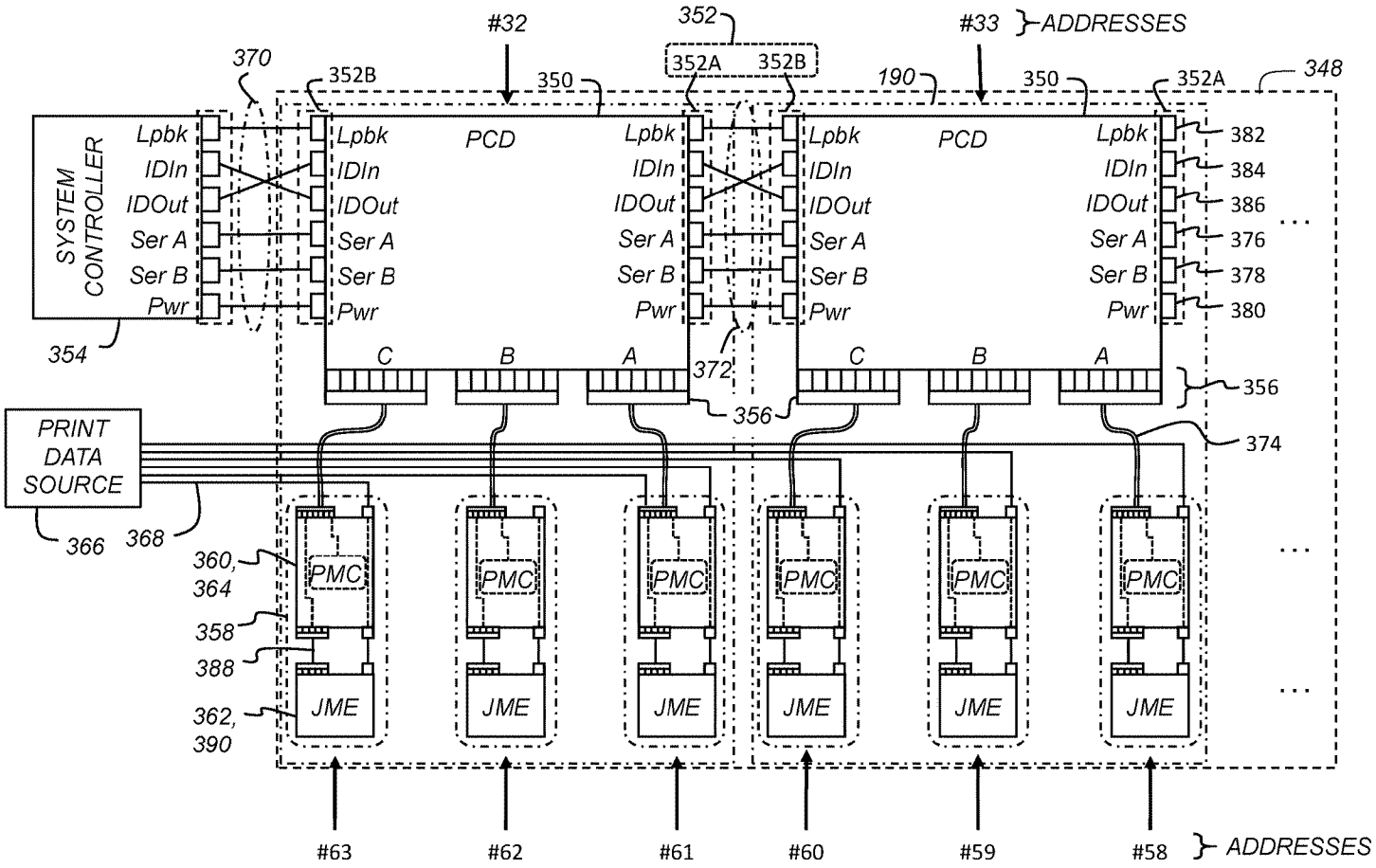
FIG. 14 shows additional details for the linehead electronics of FIG. 13.

In certain embodiments as indicated in FIG. 14, the PHE 358 associated with a printhead module 260 (FIG. 8) is packaged on two electronics boards. One board, the jetting module electronics board (JME) 362, is integrated into the field replaceable jetting module 200 (FIG. 6). It includes electronics associated with the drop formations waveform sources 55 (FIG. 1), as well as memory units for storing jetting module operating parameters and reliability data. The second board, the print module control board (PMC) 360, includes electronics for monitoring ink pressure sensors, ink temperature sensors, controlling fluid control valves, monitoring air flow sensors and controlling air flow sources, for providing the charging-electrode waveform and for detecting charge electrode shorting conditions. In some such embodiments, one of the two types of printhead electronics boards (i.e., the PMCs 360) are considered to be secondary devices 364 attached to the secondary communication ports 356 of the PCD 350, while the second type of board (i.e., the JMEs 362), are considered to be tertiary devices 390 attached to tertiary communication ports (not shown) of the PCD 350. To prevent confusion as to which type of device the system controller 354 is communicating with, a third set of communication address distinct from the first and second sets of communication addresses can be used for assignment to the tertiary devices 390. As with the second set of communication addresses, the third set of communication address can also include two subsets of communication address; one for use when incrementing the communication addresses and the other for use when decrementing the communication addresses. In certain embodiments, the tertiary devices 390 are connected to the secondary devices 364 using tertiary cables 388 as shown in FIG. 14, and communication channels for communicating with the tertiary devices 390 pass through the secondary devices 364. In such embodiments, there is not a need for tertiary communication ports on the PCD 350.

In certain exemplary embodiments of the invention, the communication cables (the umbilical cable 370, primary cables 372 and secondary cables 374) and communication ports (primary communication ports 352 and secondary communication ports 356) can include more than one serial link, as shown in FIG. 14. In a preferred embodiment, a serial A link 376 is used for communication with the PCDs 350 and with the PMCs 360, while a serial B link 378 is used for communication with the JMEs 362. With separate serial links being used for the PMCs 360 and the JMEs 362, the communication addresses assigned to the two types of printhead electronics boards associated with a given printhead module 260 can have the same value without introducing ambiguity as to which board the system controller 354 is communicating with.

The means by which the PCDs 350 detect the presence of other PCDs 350 and secondary devices 364 in an exemplary configuration is best understood by examining the different signals passed through the primary communication ports 352 and secondary communication ports 356. As shown in FIG. 14, the primary communication ports 352 and primary cables 372 include a plurality of different lines. These include power lines 380. While a single power line 380 is shown for clarity, it must be recognized that the power lines 380 can include a plurality of different conductors to accommodate a plurality of voltage levels. Also included are a serial A link 376 through which the system controller 354 can communicate with the PCDs 350 and PMCs 360, and a serial B link 378 for communicating with the JMEs 362. In certain embodiments, the serial links within the primary and secondary cables 374 correspond to twisted wire pairs that are driven with differential signals. A signal ground wire, distinct from the power ground, is associated with each of the serial links. Also, included in the communication ports and cables, are a pair of IDIn 384 and IDOut 386 lines. The IDOut 386 from one device is connected to the IDIn 384 of the connected adjacent device. Finally, the primary communication ports 352 include loopback signal lines 382, to provide validation that the connections are being properly made. While the figure shows the loopback feedback line 382 as a single wire, it can include multiple lines through which each PCD 350 can transmit a signal to an adjacent PCD 350 or system controller 354 and through which the adjacent PCD 350 or system controller 354 can send that signal back to signal-originating PCD 350.

The secondary communication ports 356 and secondary cables 374 include similar lines, except that the secondary communication ports 356 do not include the loopback signal lines 382. The secondary communication ports 356 also each include two sets of IDIn and IDOut signal lines instead of the single set in the primary communication ports 352. One set of IDIn and IDOut lines are used to test for the presence of an attached PMC 360, while the second set of IDIn and IDOut lines are used to test for the presence of the JME 362 which is connected via the PMC 360 to the secondary communication port 356 of the PCD 350. The different signal lines at the secondary communication ports 356 aren't separately labeled for clarity.

On power-up, each PCD 350 transmits a square wave on the IDOut 386 lines of its primary communication ports 352. The PMC 360, and JME 362 boards also transmit a square wave on each of their IDOut lines. In one exemplary embodiment, the square wave frequency is 125 Hz. Each of the PCD boards monitors the IDIn 384 lines of their communication ports 352, 356 to detect whether such a square wave has been transmitted by an attached device. If nothing is attached to one of the communication ports of a PCD 350, the IDIn 384 line of that communication port 352, 356 will float high. Based on detecting a sustained logic-high signal on the IDIn 384 line of a communication port 352, 356 at power up, the PCD 350 can determine that there is not a device attached to that communication port 352, 356. Unlike the other devices, the system controller 354 holds its IDOut 386 line at the logic-low level. The PCD 350 attached to the system controller 354, upon detecting the sustained logic-low signal instead of the square wave or the logic-high signal at one of its two primary communication ports 352, determines that it is connected to the system controller 354 using that primary communication port 352. It then sets the logic level at the IDOut 386 lines of its primary and secondary communication ports 352, 356 to low. It then proceeds to assign communication addresses to itself and the attached devices as previously described. The downstream PCD 350 and secondary devices 364 attached to the first PCD 350 upon detecting the change to IDOut 386 signal from the first PCD 350 to logic-low, stop transmitting the square wave signals on their IDOut 386 lines, holding their IDOut 386 lines at logic-high. The PCD 350 transmits the communication addresses on the IDOut 386 line of the communication port to the IDIn 384 of the attached device. In one embodiment, the address information is transmitted at a 250 Hz bit rate. The address information is transmitted as a 32-bit message that includes two start bits, each at logic-low, and one stop bit at logic-high. The device receiving the address message uses its IDOut 386 line to echo the address message back to the first PCD 350. In addition to echoing back the address message, messages over the IDOut 386 and IDIn 384 lines can include other configuration data, such as baud rates for the serial links, whether the serial link data is encrypted or not, the device type, and device serial number information. Following the echoing of the address message back to the first PCD 350, the attached PMC 360 and JME 362 boards hold their IDOut 386 lines at logic-low. If these devices are disconnected from the PCD 350, the corresponding IDIn 384 port of the PCD 350 will no longer be held low and it will float high, providing a signal to the PCD 350 that the device has been removed.

The use of the IDOut 386 and IDIn 384 lines within the communication ports and cables that are distinct from the serial links within the communication ports enables them to not only transmit communication address information to the attached devices, but also to monitor whether devices are attached. This enables the PCDs 350 to continually monitor their ports to detect newly connected or disconnected devices, even while continuing to relay communications to the attached devices through the serial links within the communication ports. As the PCD 350 detects a newly connected or disconnected device, it assigns or un-assigns a communication address for that device. It then updates its address assignment table and notifies the system controller 354 of the change in the address assignment table.

In certain applications in which the integrity of a communication network is important, the ability to continually monitor for newly connected or disconnected devices on the network, provides a level of security against unauthorized removal and installation of devices on the communication network.

When the second PCD 350 receives the next available communication address from the first set of communication address and from the second set of communication addresses, it assigns communication addresses to itself and to each of the attached devices and communicates the communication addresses to the attached devices in the same way.

In some embodiments, each PCD 350 transmits to the next PCD 350 in the daisy chain the last used communication addresses from the first set and from the second set of communication address rather than the next available communication addresses. The receiving PCD then determines the next available communication addresses based on the received last used communication address.

Figure 15:
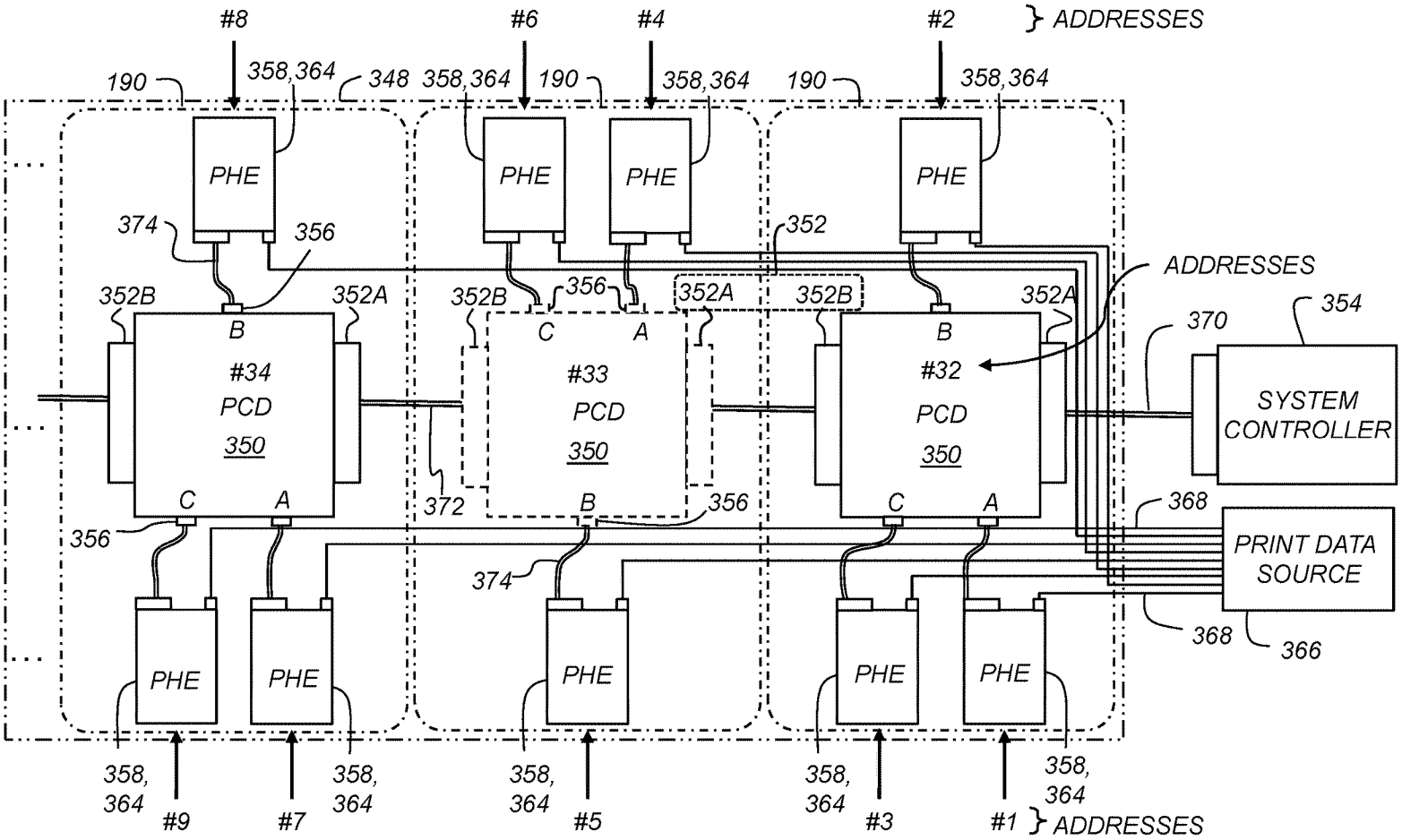
FIG. 15 shows a block diagram of the linehead electronics with a plurality of communication distribution devices and attached secondary devices, the communication distribution device having an alternate configuration of secondary communication ports.

In some embodiments, the secondary communication ports 356 are not aligned in a row on the PCD 350, but rather the secondary communication ports 356 are alternately placed along two opposite edges of the PCD 350, typically the upstream and downstream edges, as shown in FIG. 15. This configuration reduces the spacing between the secondary communication ports 356 and the printhead electronics to which they are connected by means of a secondary cable 374. As was noted earlier, adjacent printhead assemblies 190 within a linehead 348 have opposite orientations; with one printhead assembly having two printhead modules 260 on the downstream side of the central mounting rail assembly 220 (FIG. 6) and one printhead module 260 on the upstream side, and adjacent modular printhead assemblies 190 have one printhead module 260 on the downstream side of the central mounting rail assembly 220 and two printhead modules 260 on the upstream side.

To facilitate connection of the secondary cables 374 between the secondary communication ports 356 and the associated PHEs 358, it is desirable to similarly alter the orientation of adjacent PCDs 350 within the linehead. In the exemplary embodiment of FIG. 15, the center PCD 350 has been inverted (denoted by the dashed outline of the PCD 350) by rotating the PCD 350 about an axis passing through both primary communication ports 352. By inverting the PCD 350 in this manner, the first primary communication port 352A remains on the right side of the PCD 350, similar to the non-inverted PCDs 350. (The primary and secondary cables 372, 374 have sufficient slack to allow these cables to be twisted to enable making the proper connections to the inverted PCDs 350.) The addressing of the secondary devices 364 attached to the inverted PCD 350 proceeds as described for the previous embodiments.

In the exemplary embodiments, the PCDs 350 do not act as gatekeepers for communications passing through the one or more serial links of the communication ports. Instead all communications received via a serial link at one of primary communication port 352 of a PCD 350 are transmitted to the corresponding serial link of each of the secondary communication ports 356 and of the other primary communication port 352.

While the invention has been described with respect to an embodiment in which the PCDs 350 each have three secondary communication ports 356, the number of secondary communication ports 356 is not limited to three. The PCDs 350 can have any number of secondary communication ports 356 greater than or equal to 1. Furthermore, the different PCDs 350 within a production system can vary in their number of secondary communication ports 356.

While this invention has been described with respect to a printing system, this invention also has applicability to other types of production systems in which a system controller monitors or controls the operation of a plurality of production tools or instruments. In one such embodiment, the production system includes a plurality of manufacturing cells arranged along a production path, with each cell including a number of devices to act on the units being made. In such a system, each manufacturing cell might include a communication distribution device through which the production tools of the manufacturing cell are connected to a system controller. The communication distribution devices associated with each of the manufacturing cells along the production path are connected in a daisy chain fashion. The present invention is particularly useful in such production systems where there is a need to frequently remove and replace individual tools in the various production cells and a need for the system controller to know where along the production path the individual tools are located.

Outside of the field of production systems, the invention has applicability in communication networks in environments such as in hospitals where a variety of different types of patient monitoring instruments can be moved from one patient treatment room to another, and in which a system controller, perhaps at a nurse's station, must unambiguously know the location of each of the connected patient monitoring instruments. In such an environment, each patient treatment room or patient treatment station might include a communication distribution device, each having a plurality of secondary communication ports to which the patient monitoring instruments can be connected as secondary devices.

The present invention has been described with respect to methods and system components for assigning communication addresses in an inkjet printing production system. It will be obvious to one skilled in the art that an equivalent solution can be applied to other types of production systems having a chain of communication distribution devices, each having ports for connecting to a plurality of secondary devices.

The invention has been described in detail with particular reference to certain preferred embodiments thereof, but it will be understood that variations and modifications can be effected within the spirit and scope of the invention.

PARTS LIST

20 printing system
22 image source
24 image processing unit (image processor)
26 control circuits
27 synchronization device
28 drop-forming transducer
30 printhead
32 print medium
34 print medium transport system
35 speed measurement device
36 media transport controller
38 micro-controller
40 ink reservoir
44 ink recycling unit
46 ink pressure regulator
47 ink channel
48 jetting module
49 nozzle plate
50 nozzle
51 heater
52 liquid stream
54 drop
55 drop formation waveform source
57 trajectory
59 breakoff location
60 drop formation waveform
61 charging device
62 charging electrode
62' charging electrode
63 charging-electrode waveform source
64 charging-electrode waveform
66 printing drop
68 non-printing drop
69 drop selection system
70 deflection mechanism
71 deflection electrode
72 ink catcher
74 catcher face
76 ink film
78 liquid channel
79 lower plate
80 charging-electrode waveform period
82 first voltage state
84 second voltage state
86 non-print trajectory
88 print dot
92-1 drop-formation waveform
92-2 drop-formation waveform
92-3 drop-formation waveform

94-1 drop-formation waveform
94-2 drop-formation waveform
94-3 drop-formation waveform
94-4 drop-formation waveform
96 period
98 pulse
100 period
102 pulse
104-1 large drop
104-2 large drop
104-3 large drop
106-1 small drop
106-2 small drop
106-3 small drop
106-4 small drop
108 phase shift
112 printhead assembly
116 in-track direction
118 cross-track direction
132 printing region
134 overlap region
136 centerline
138 nozzle array spacing
190 printhead assembly
200 jetting module
202 nozzle array
216 fluid connections
217 electrical connections
220 rail assembly
222 beam
224 rod
226 downstream side
228 upstream side
240 mounting assembly
260 printhead module
300 printing system
348 linehead
350 power communication distribution board (PCD)
352 primary communication port
352A first primary communication port
352B second primary communication port
354 system controller
355 spacing
356 secondary communication port
358 printhead electronics board (PHE)
360 print module control board (PMC)
362 jetting module electronics board (JME)
364 secondary device
366 print data source
368 optical fiber
370 umbilical cable
372 primary cable
374 secondary cable
376 serial A link
378 serial B link
380 power line
382 loopback signal line
384 IDIn
386 IDOut
388 tertiary cable
390 tertiary device

The invention claimed is:

1. A method for assigning communication addresses to devices within a production system, comprising:

providing a system controller for controlling the production system, the system controller including a communication port;

providing a plurality of communication distribution devices, each of the communication distribution devices including:

first and second primary communication ports through which the communication distribution device can be connected to another communication distribution device or to the system controller;

a plurality of secondary communication ports, the plurality of secondary communication ports being arranged in a defined sequence; and signal detector configured to detect signals passing through the first and second primary communication ports to detect whether the communication distribution device is connected via the first primary communication port or the second primary communication port to another one of the plurality of communication distribution devices or to the system controller;

connecting the plurality of communication distribution devices together using the first and second primary communication ports in a daisy chain arrangement to form a connected sequence of communication distribution devices, wherein a first communication distribution device in the sequence of communication distribution devices is connected to the system controller via one of its first and second primary communication ports such that each communication distribution device is enabled to communicate with the system controller;

providing a plurality of secondary devices;

connecting each of the secondary devices to one of the secondary communication ports of one of the communications distribution devices;

specifying a first set of communication addresses from which communication addresses can be assigned to each of the communication distribution devices, the communication addresses of the first set of communication addresses having a prescribed sequence;

specifying a second set of communication addresses distinct from the first set of communication addresses, from which communication addresses can be assigned to each of the secondary devices, the communication addresses of the second set of communication addresses having a prescribed sequence;

wherein the system controller provides a signal to a first communication distribution device in the connected sequence of communication distribution devices via one of its first and the second primary communication ports;

upon detecting the signal from the system controller by the first communication distribution device, the first communication distribution device:

assigns itself a first communication address in the prescribed sequence of the first set of communication addresses;

sequentially assigns communication addresses from the prescribed sequence of the second set of communication addresses to the secondary devices connected to its secondary communication ports; and communicates address information to the next communication distribution device in the connected sequence of communication distribution devices via one of its first and second primary communication ports, the address information specifying that the next communication distribution device should assign itself a next communication address in the prescribed sequence of the first set of communication addresses and specifying the next available communication address in the prescribed sequence of the second set of communication addresses that is available to be assigned to the secondary devices connected to the next communication distribution device;

upon receiving the communicated address information from the previous communication distribution device in the connected sequence of communication distribution devices each subsequent communication distribution device in the connected sequence of communication distribution devices:

assigns itself the received communication address in the prescribed sequence of the first set of communication addresses;

sequentially assigns communication addresses from the prescribed sequence of the second set of communication addresses to the secondary devices connected to its secondary communication ports starting with the received next available communication address; and unless it is the last communication distribution device in the connected sequence of communication distribution devices, communicates address information to the next communication distribution device in the connected sequence of communication distribution devices via one of its first and second primary communication ports, the address information specifying that the next communication distribution device should assign itself a next communication address in the prescribed sequence of the first set of communication addresses and specifying the next available communication address in the prescribed sequence of the second set of communication addresses that is available to be assigned to the secondary devices connected to the next communication distribution device; and transmitting address information from each communication distribution device in the connected sequence of communication distribution devices to the system controller, the address information specifying the communication addresses assigned to each communication distribution device and the communication addresses assigned to each of the secondary devices connected to each communication distribution device.

2. The method of claim 1, wherein the secondary devices are arranged in prescribed physical positions and are connected to the secondary communication ports of the connected sequence of communication distribution devices in a prescribed arrangement, and wherein the communication distribution devices assign the communication addresses to the connected secondary devices in a prescribed sequence such that the communication addresses assigned to the secondary devices provide an indication of the physical positions of the secondary devices.

3. The method of claim 2, wherein the production system is an inkjet printing system, wherein the secondary devices are control systems for corresponding jetting modules in the inkjet printing system, the jetting modules being arranged at different physical positions across a width of a web of receiver medium such that each jetting module prints on the web of receiver medium in a corresponding swath position, and wherein the communication address assigned to a particular secondary device provides an indication of the corresponding swath position associated with the jetting modules.

4. The method of claim 1, wherein if the first communication distribution device in the sequence of communication distribution devices is connected to the system controller via its first primary communication port the communication addresses for the secondary devices are assigned in an ascending sequence, and if the first communication distribution device in the sequence of communication distribution devices is connected to the system controller via its second primary communication port the communication addresses for the secondary devices are assigned in a descending sequence.

5. The method of claim 4, wherein if the communication addresses for the secondary devices are assigned in an ascending sequence they are assigned from a first subset of the second set of communication addresses, and if the communication addresses for the secondary devices are assigned in an descending sequence they are assigned from a second subset of the second set of communication addresses.

6. The method of claim 1, wherein the communication distribution devices associate communication addresses with each of their secondary communication ports even if secondary devices are not connected to all of the secondary communication ports.

7. The method of claim 1, wherein the prescribed sequence of communication addresses in the first set of communication addresses is a sequence of consecutive integers.

8. The method of claim 1, wherein the prescribed sequence of communication addresses in the second set of communication addresses is a sequence of consecutive integers.

9. The method of claim 1, wherein tertiary devices are connected to some or all of the secondary devices.

10. The method of claim 9, wherein communication addresses for the tertiary devices are assigned from a third set of communication addresses distinct from the first and second sets of communication addresses, the communication addresses of the third set of communication addresses having a prescribed sequence.

11. The method of claim 9, wherein the tertiary devices share the same communication addresses as the secondary devices to which they are connected, and wherein the primary and secondary communication ports include separate serial communication links to communicate with the secondary and tertiary devices.

12. The method of claim 1, wherein the communication distribution devices detect that another communication distribution device is connected to one of its first and second primary communication ports by detecting a prescribed signal transmitted through a cable connecting the communication distribution devices.

13. The method of claim 1, wherein the communication distribution devices detect that a secondary device is connected to one of its secondary communication ports by detecting a prescribed signal transmitted through a cable connecting the communication distribution device and the secondary device.

14. The method of claim 1, wherein each communication distribution device creates a table of assigned communication addresses which it transmits to the system controller.

15. The method of claim 1, wherein each communication distribution device has the same number of secondary communication ports.

16. The method of claim 1, wherein the primary and secondary communication ports each include at least one serial communication link.

17. The method of claim 16, wherein data transmitted via the serial communication link pass through the communication distribution device without being directed by the communication distribution device to a particular communication port.

18. The method of claim 16, wherein the address information communicated to the next communication distribution device in the connected sequence of communication distribution devices via one of its first and second primary communication ports pass through communication lines in the first and second primary communication ports that are distinct from the serial communication link.

19. The method of claim 18, wherein signals pass through the communication lines in the first and second primary communication ports that are distinct from the serial communication link to enable the communication distribution device to detect that the next communication distribution device has been attached or detached from one of this first and second primary communication ports.

* * * * *